US011518182B2

(12) United States Patent
Ohata et al.

(10) Patent No.: US 11,518,182 B2
(45) Date of Patent: Dec. 6, 2022

(54) CLEANING DEVICE AND IMAGE FORMING APPARATUS

(71) Applicant: KYOCERA Document Solutions Inc., Osaka (JP)

(72) Inventors: Shinobu Ohata, Osaka (JP); Naoto Miyakoshi, Osaka (JP); Shunsuke Yamasaki, Osaka (JP); Hiroatsu Tamai, Osaka (JP); Yasuhiro Michishita, Osaka (JP); Takeshi Watanabe, Osaka (JP); Hiroki Sakane, Osaka (JP); Kenichi Satake, Osaka (JP); Masato Usui, Osaka (JP); Yuzuru Yuasa, Osaka (JP); Yusuke Tamekuni, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/384,755

(22) Filed: Jul. 24, 2021

(65) Prior Publication Data

US 2021/0347189 A1 Nov. 11, 2021

Related U.S. Application Data

(62) Division of application No. 16/885,818, filed on May 28, 2020, now Pat. No. 11,090,962.

(30) Foreign Application Priority Data

May 30, 2019 (JP) ..... JP2019-101716
Sep. 26, 2019 (JP) ..... JP2019-175339

(51) Int. Cl.
*B41J 29/17* (2006.01)
*B41J 11/00* (2006.01)
(Continued)

(52) U.S. Cl.
CPC ..... *B41J 29/17* (2013.01); *B41J 11/007* (2013.01); *B41J 13/02* (2013.01); *B08B 1/02* (2013.01)

(58) Field of Classification Search
CPC . B41J 29/02; B41J 11/007; B41J 13/02; B41J 29/17
See application file for complete search history.

(56) References Cited

U.S. PATENT DOCUMENTS

2009/0095182 A1* 4/2009 Hanada ..... B41J 29/02 101/423
2009/0188529 A1 7/2009 Maynard et al.
(Continued)

FOREIGN PATENT DOCUMENTS

JP 2004-345805 12/2004
JP 2006-117420 5/2006

*Primary Examiner* — Scott A Richmond
(74) *Attorney, Agent, or Firm* — Gerald E. Hespos; Michael J. Porco

(57) ABSTRACT

A cleaning device includes a cleaning unit, a movement mechanism, and a unit mounting portion. The cleaning unit includes a cleaning part having a contact surface brought into contact with a surface of a conveyance roller. The movement mechanism moves the cleaning unit between a cleaning position at which the cleaning part comes in contact with the conveyance roller, and a mounting and removing position at which the cleaning part is located below the conveyance roller in a separated manner and the cleaning unit is allowed to be mounted and removed on and from the apparatus body. The unit mounting portion houses the cleaning unit disposed at the mounting and removing position. The cleaning unit is configured such that the cleaning unit in a state of being housed in the unit mounting portion is mounted and removed, together with the processing unit, on and from the apparatus body.

10 Claims, 33 Drawing Sheets

(51) Int. Cl.
*B41J 13/02* (2006.01)
*B08B 1/02* (2006.01)

(56) References Cited

U.S. PATENT DOCUMENTS

| | | | |
|---|---|---|---|
| 2010/0232849 | A1 | 9/2010 | Nanataki et al. |
| 2017/0113476 | A1 | 4/2017 | Hara et al. |

* cited by examiner

CLEANING DEVICE AND IMAGE FORMING APPARATUS

CROSS-REFERENCE TO RELATED APPLICATION

This application is a divisional of U.S. patent application Ser. No. 16/885,818, filed on May 28, 2020.

BACKGROUND

Field of the Invention

The present disclosure relates to a cleaning device for cleaning a conveyance roller which conveys a sheet, and an image forming apparatus which includes the cleaning device.

Related Art

In an image forming apparatus such as a printer, a sheet is conveyed to a predetermined image forming position, and an image is formed on the sheet at the image forming position. Conventionally, there has been known a pair of resist rollers which is used for feeding a sheet to an image forming position. The pair of resist rollers each has a length corresponding to a width of a sheet, and forms a nip portion through which the sheet passes. When a distal end portion of the sheet is brought into contact with the nip portion in a state where the rotation of the pair of resist rollers is stopped, skewing of the sheet is straightened. Then, when the pair of resist rollers is rotated, the sheet is conveyed into the nip portion and, thereafter, the sheet is fed out (conveyed) in accordance with appropriate image forming timing at the image forming position.

Conventionally, there has been known a cleaning device which removes paper dust adhering to a surface of each resist roller. In such a cleaning device, a web which is wound in a roll shape is taken up by a take-up roller. Accordingly, a new web surface is brought into contact with a surface of the resist roller so that paper dust is removed.

In the above-mentioned prior art, out of the pair of resist rollers, the web is brought into contact with the surface of the resist roller disposed on a lower side, and the web cleans the surface. Each time the resist roller is cleaned by the web, a web take-up operation is performed by the take-up roller, and a portion of the web which is brought into contact with the resist roller changes.

SUMMARY

A cleaning device according to an aspect of the present disclosure is attached to an image forming apparatus including an apparatus body, a conveyance roller supported rotatably on the apparatus body, the conveyance roller conveying a sheet, and a processing unit configured to be mounted and removed on and from the apparatus body, and is configured to clean a surface of the conveyance roller. The cleaning device includes a cleaning unit, a movement mechanism, and a unit mounting portion.

The cleaning unit includes a cleaning part having a contact surface extending along an axial direction of the conveyance roller, the contact surface being brought into contact with the surface of the conveyance roller from below to clean the surface of the conveyance roller. The movement mechanism moves the cleaning unit between a cleaning position at which the cleaning part comes in contact with the conveyance roller, and a mounting and removing position at which the cleaning part is disposed below the conveyance roller in a separated manner and the cleaning unit is allowed to be mounted and removed on and from the apparatus body. The unit mounting portion is disposed on the processing unit, and allows the cleaning unit disposed at the mounting and removing position to be mounted on the unit mounting portion. The cleaning unit is configured such that the cleaning unit in a state of being housed in the unit mounting portion is mounted and removed, together with the processing unit, on and from the apparatus body.

An image forming apparatus according to another aspect of the present disclosure includes: an apparatus body; a conveyance roller supported rotatably on the apparatus body, the conveyance roller conveying a sheet; and the above cleaning device that can clean a surface of the conveyance roller.

DETAILED DESCRIPTION

Hereinafter, a cleaning device and an image forming apparatus according to an embodiment of the present disclosure are described with reference to drawings.

Figure 1:
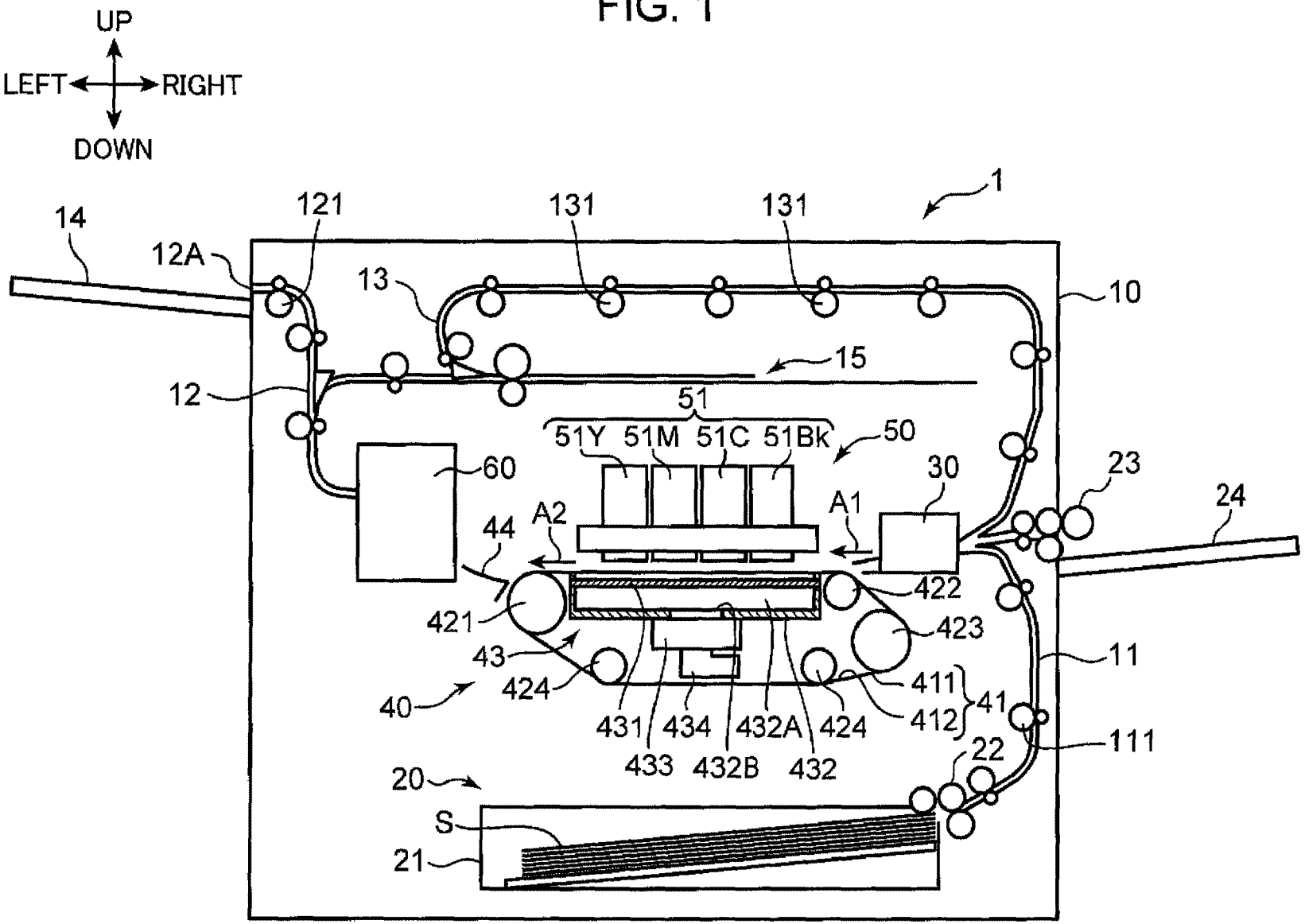
FIG. 1 is a schematic cross-sectional view showing an internal structure of an image forming apparatus according to an embodiment of the present disclosure.

FIG. 1 is a schematic cross-sectional view showing an internal structure of an image forming apparatus 1 according to the embodiment of the present disclosure. The image forming apparatus 1 shown in FIG. 1 is an ink jet recording apparatus which forms (records) an image on a sheet S by ejecting ink droplets. The image forming apparatus 1 includes an apparatus body 10, a paper supply unit 20, a resist roller unit 30, a belt conveyance unit 40, an image forming unit 50, and a curl correction unit 60.

The apparatus body 10 is a box-shaped housing that houses various devices for forming an image on the sheet S. In the apparatus body 10, a first conveyance path 11, a second conveyance path 12, and a third conveyance path 13 which form a conveyance path of the sheet S are formed.

The paper supply unit 20 supplies the sheet S to the first conveyance path 11. The paper supply unit 20 includes a paper supply cassette 21 and a paper supply roller 22. The paper supply cassette 21 is detachably mounted on the apparatus body 10 and sheets S are stored in the paper supply cassette 21. The paper supply roller 22 is disposed on a right side of an upper end portion of the paper supply cassette 21. The paper supply roller 22 conveys the sheet S stored in the paper supply cassette 21 to a downstream side of the first conveyance path 11.

The sheet S supplied to the first conveyance path 11 is conveyed to the resist roller unit 30 disposed on a downstream end of the first conveyance path 11 by a pair of first conveyance rollers 111 disposed on the first conveyance path 11. A paper supply tray 24 is disposed on a right side surface of the apparatus body 10, and sheets S can be placed on an upper surface of the paper supply tray 24. The sheets S placed on the paper supply tray 24 are fed out toward the resist roller unit 30 by the paper supply roller 23.

The resist roller unit 30 is a device which conveys the sheet S conveyed by way of the first conveyance path 11 or the paper supply roller 23 toward a conveyance belt 41 of the belt conveyance unit 40 in a sheet conveyance direction A1. The resist roller unit 30 and the belt conveyance unit 40 convey the sheet S at different positions. Details of the resist roller unit 30 are described later.

The sheet S conveyed by the resist roller unit 30 is conveyed by the belt conveyance unit 40 in a sheet conveyance direction A2. The sheet conveyance directions A1 and A2 are leftward directions in FIG. 1.

The belt conveyance unit 40 is an example of a processing unit, and is disposed under the image forming unit 50. The belt conveyance unit 40 conveys the sheet S conveyed by the resist roller unit 30 in the sheet conveyance direction A2 toward the curl correction unit 60 such that the sheet S passes below the image forming unit 50. The belt conveyance unit 40 includes the conveyance belt 41 (conveyance portion), a first support roller 421, a second support roller 422, a third support roller 423, a pair of fourth support rollers 424, and a suction unit 43.

The conveyance belt 41 is an endless belt having a predetermined width in a front-rear direction and extending in a left-right direction. The conveyance belt 41 is disposed so as to face the image forming unit 50, and conveys the sheet S in the sheet conveyance direction A2 on an outer peripheral surface 411. An image forming position where an image is formed on the sheet S by the image forming unit 50 is set on an orbital movement path of the conveyance belt 41.

The conveyance belt 41 is supported in an extended manner between and by the first support roller 421, the second support roller 422, the third support roller 423, and the pair of fourth support rollers 424. The suction unit 43 is disposed inside the conveyance belt 41 which is supported in an extended manner as described above in a state where the suction unit 43 faces an inner peripheral surface 412 of the conveyance belt 41. The first support roller 421 is rotatably driven by a drive motor (not shown), and allows the conveyance belt 41 to orbit in a predetermined orbital direction. The conveyance belt 41 has a plurality of suction holes penetrating the conveyance belt 41 in a thickness direction from the outer peripheral surface 411 to the inner peripheral surface 412.

The suction unit 43 is disposed so as to face the image forming unit 50 with the conveyance belt 41 interposed therebetween. The suction unit 43 brings the sheet S into close contact with the outer peripheral surface 411 of the conveyance belt 41 by generating a negative pressure between the sheet S held on the outer peripheral surface 411 of the conveyance belt 41 and the conveyance belt 41. The suction unit 43 includes a belt guide member 431, a suction housing 432, a suction device 433, and an exhaust duct 434.

The belt guide member 431 guides the orbital movement of the conveyance belt 41 in an interlocking manner with the rotation of the first support roller 421 between the first support roller 421 and the second support roller 422.

The suction unit 43 generates a suction force by sucking air from a space above the conveyance belt 41 through a groove portion and a through hole formed in the belt guide member 431 and the suction holes of the conveyance belt 41. Due to such a suction force, an airflow (suction air) toward the suction unit 43 is generated in a space formed above the conveyance belt 41. When the sheet S is conveyed onto the conveyance belt 41 by the resist roller unit 30 and covers a part of the outer peripheral surface 411 of the conveyance belt 41, a suction force (negative pressure) acts on the sheet S, and the sheet S is brought into close contact with the outer peripheral surface 411 of the conveyance belt 41.

The suction housing 432 is a box-shaped housing having an upper opening, and the suction housing 432 is disposed below the conveyance belt 41 such that the upper opening is covered by the belt guide member 431. The suction housing 432 defines a suction space 432A in cooperation with the belt guide member 431.

An opening portion 432B is formed in a bottom wall portion of the suction housing 432, and the suction device 433 is disposed corresponding to the opening portion 432B. The exhaust duct 434 is connected to the suction device 433. The exhaust duct 434 is connected to an exhaust port (not shown) formed in the apparatus body 10.

The image forming unit 50 is disposed above the belt conveyance unit 40. The image forming unit 50 forms an image by applying image forming processing to the sheet S which is conveyed in the sheet conveyance direction A2 in a state where the sheet S is held on the outer peripheral surface 411 of the conveyance belt 41. In this embodiment, an image forming method of the image forming unit 50 is an ink jet method, and an image is formed on the sheet S by ejecting ink droplets.

The image forming unit 50 includes line heads 51 (51Bk, 51C, 51M, 51Y). The line head 51Bk ejects black ink droplets, the line head 51C ejects cyan ink droplets, the line head 51M ejects magenta ink droplets, and the line head 51Y ejects yellow ink droplets. The line heads 51Bk, 51C, 51M, and 51Y are arranged adjacently to each other from the upstream side to the downstream side in the sheet conveyance direction A1.

The line heads 51 form an image on the sheet S by ejecting ink droplets on the sheet S conveyed in the sheet conveyance direction A2 in a state where the sheet S is held on the outer peripheral surface 411 of the conveyance belt 41. As a result, an image is formed on the sheet S.

The sheet S on which the image is formed is conveyed by the conveyance belt 41, and is discharged (fed out) toward the curl correction unit 60 while being guided by a sheet discharge guide unit 44. The curl correction unit 60 is disposed downstream of the conveyance belt 41 in the sheet conveyance direction A2 with the sheet discharge guide unit 44 sandwiched therebetween. The curl correction unit 60 corrects the curl of the sheet S on which the image is formed while conveying the sheet S to the downstream side.

The sheet S whose curl has been corrected by the curl correction unit 60 is fed out to the second conveyance path 12. The second conveyance path 12 extends along a left side surface of the apparatus body 10. The sheet S fed out to the second conveyance path 12 is conveyed by a pair of second conveyance rollers 121 disposed on the second conveyance path 12 toward a paper discharge port 12A formed on a left side of the apparatus body 10, and the sheet S is discharged onto a paper discharge unit 14 from the paper discharge port 12A.

On the other hand, in a case where both-side printing is performed on the sheet S, the sheet S on which the image forming processing of a first surface (front surface) has been completed is fed out from the second conveyance path 12 to a sheet reversing unit 15. The sheet reversing unit 15 is a conveyance path branched from a middle portion of the second conveyance path 12, and is a part where the sheet S is reversed (switched back). The sheet S where the front surface and the back surface are reversed by the sheet reversing unit 15 is fed out to the third conveyance path 13. The sheet S fed out to the third conveyance path 13 is reversely fed by a pair of third conveyance rollers 131 provided in the third conveyance path 13, and is supplied again onto the outer peripheral surface 411 of the conveyance belt 41 by way of the resist roller unit 30 in a state where the front surface and the back surface of the sheet S are reversed. With respect to the sheet S supplied onto the outer peripheral surface 411 of the conveyance belt 41 in a state where the front surface and the back surface of the sheet S are reversed as described above, the image forming processing is applied to a second surface (back surface) on a side opposite to the first surface of the sheet S by the image forming unit 50 while being conveyed by the conveyance belt 41. The sheet S on which both-side printing has been completed passes through the second conveyance path 12, and is discharged onto the paper discharge unit 14 from the paper discharge port 12A.

Figure 2:
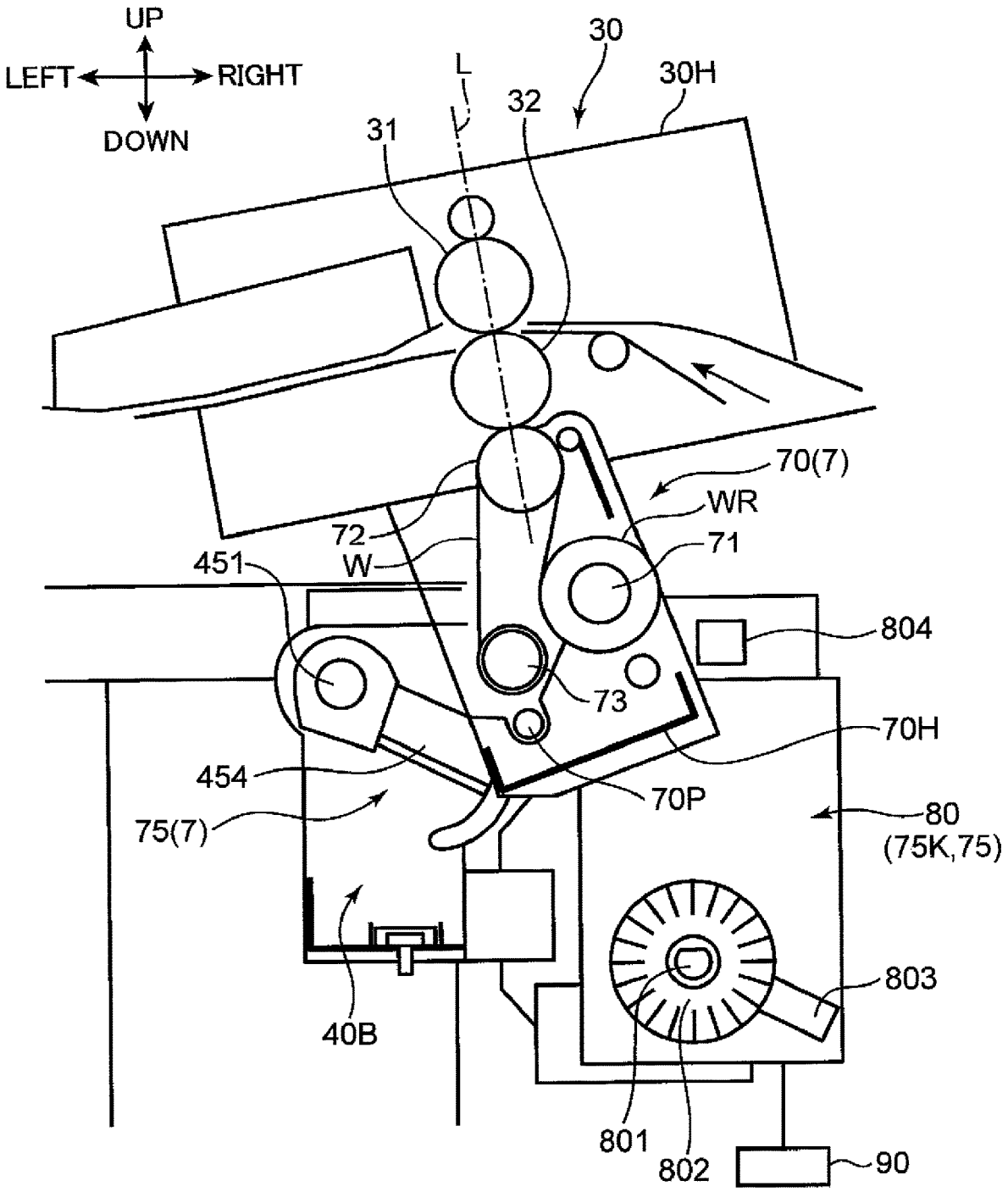
FIG. 2 is a cross-sectional view of a pair of resist rollers, a cleaning unit of the image forming apparatus and the surrounding of these parts, and is also a cross-sectional view showing a state where the cleaning unit is disposed at a cleaning position.

FIG. 2 is a cross-sectional view of the pair of resist rollers, the cleaning unit 70 of the image forming apparatus 1 and the surrounding of these parts according to the present embodiment, and is a cross-sectional view showing a state where the cleaning unit 70 is disposed at a cleaning position.

The above resist roller unit 30 has a resist housing 30H and a pair of resist rollers consisting of a resist upper roller 31 and a resist lower roller 32 (conveyance roller). The resist housing 30H is mounted on the apparatus body 10, and rotatably supports the resist upper roller 31 and the resist lower roller 32. The sheet S is conveyed into a nip portion formed between the pair of resist rollers as indicated by an arrow in FIG. 2 in the resist housing 30H. The resist roller unit 30 has a roller drive unit (not shown) that drives the resist upper roller 31 and the resist lower roller 32 to rotate.

The resist upper roller 31 is a roller disposed on an upper side out of the pair of resist rollers. The resist upper roller 31 is formed of a metal roller.

The resist lower roller 32 is a roller disposed on a lower side out of the pair of resist rollers. The resist lower roller 32 is formed of a rubber roller, and a tetrafluoroethylene-perfluoroalkoxy ethylene copolymer resin (PFA) tube is wound around (fitted in) an outer peripheral surface of the resist lower roller 32.

As shown in FIG. 2, a straight line L connecting the center of the resist upper roller 31 and the center of the resist lower roller 32 is inclined at an acute angle (for example, 10 degrees) with respect to a vertical direction. In other words, the resist lower roller 32 is disposed at the position displaced upstream in a conveyance direction of the sheet S with respect to the resist upper roller 31.

Figure 26:
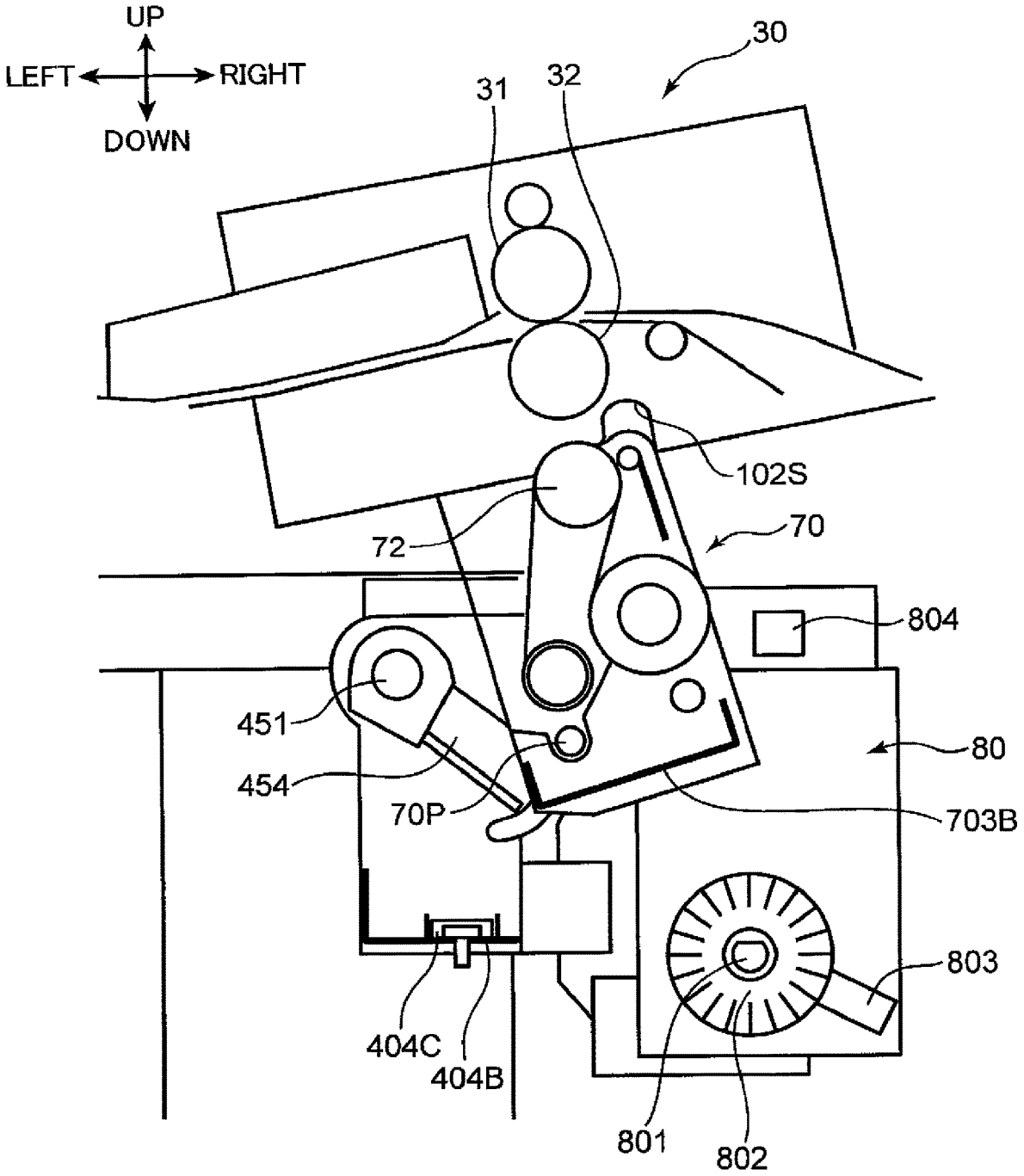
FIG. 26 is a cross-sectional view showing a state where the cleaning unit is disposed at a separation position.

Further, the image forming apparatus 1 includes a cleaning device 7. The cleaning device 7 can clean a surface of the resist lower roller 32. The cleaning device 7 has the cleaning unit 70 and a movement mechanism 75 (see FIG. 14). The movement mechanism 75 has a function of moving the cleaning unit 70 between the cleaning position (FIG. 2), a mounting and removing position (FIG. 24), and a separation position (FIG. 26).

Figure 3:
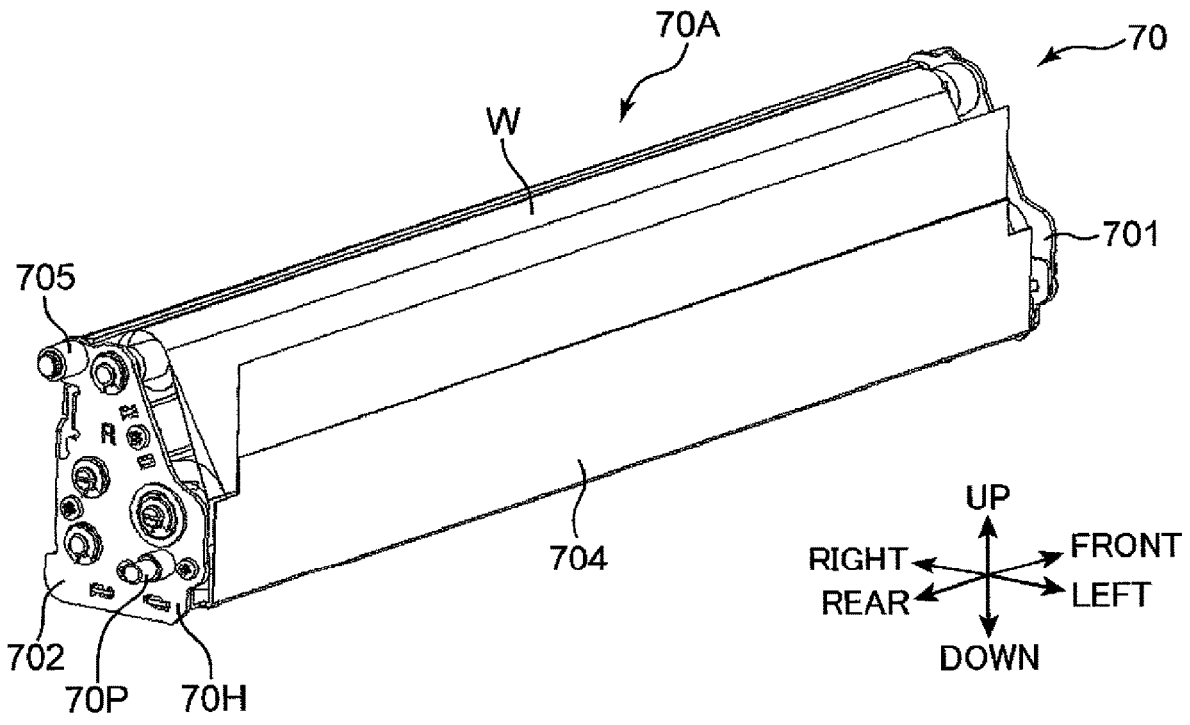
FIG. 3 is a perspective view of the cleaning unit.
Figure 4:
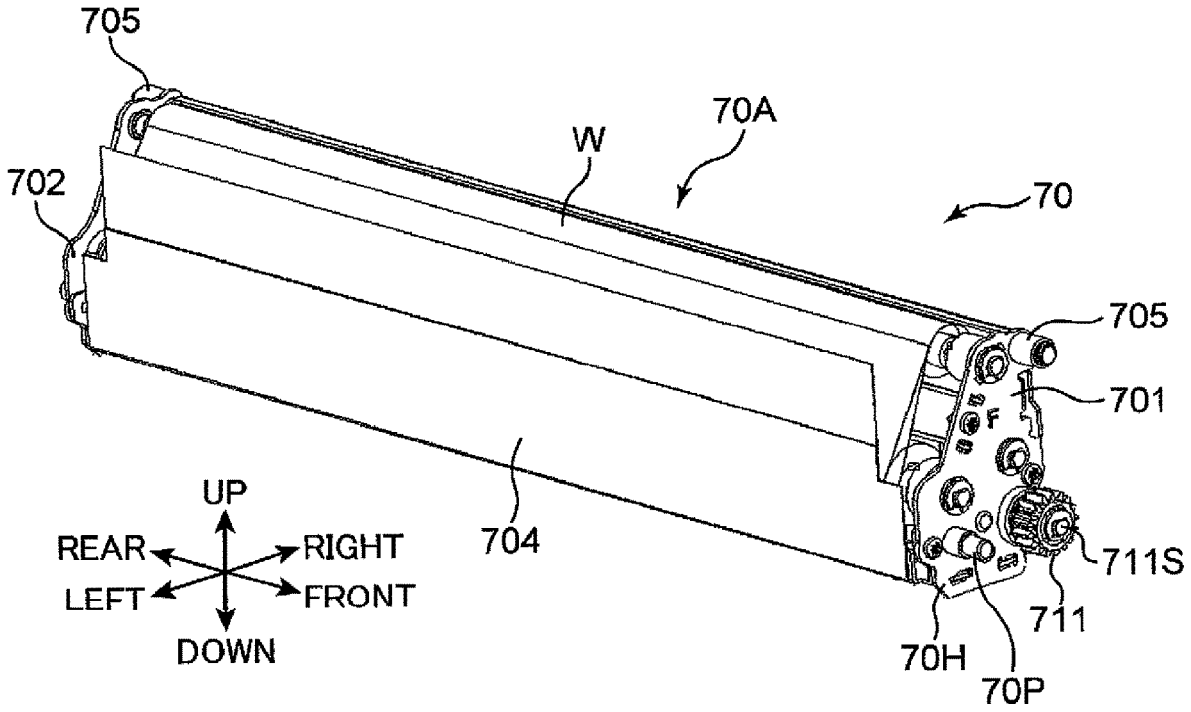
FIG. 4 is a perspective view of the cleaning unit.
Figure 5:
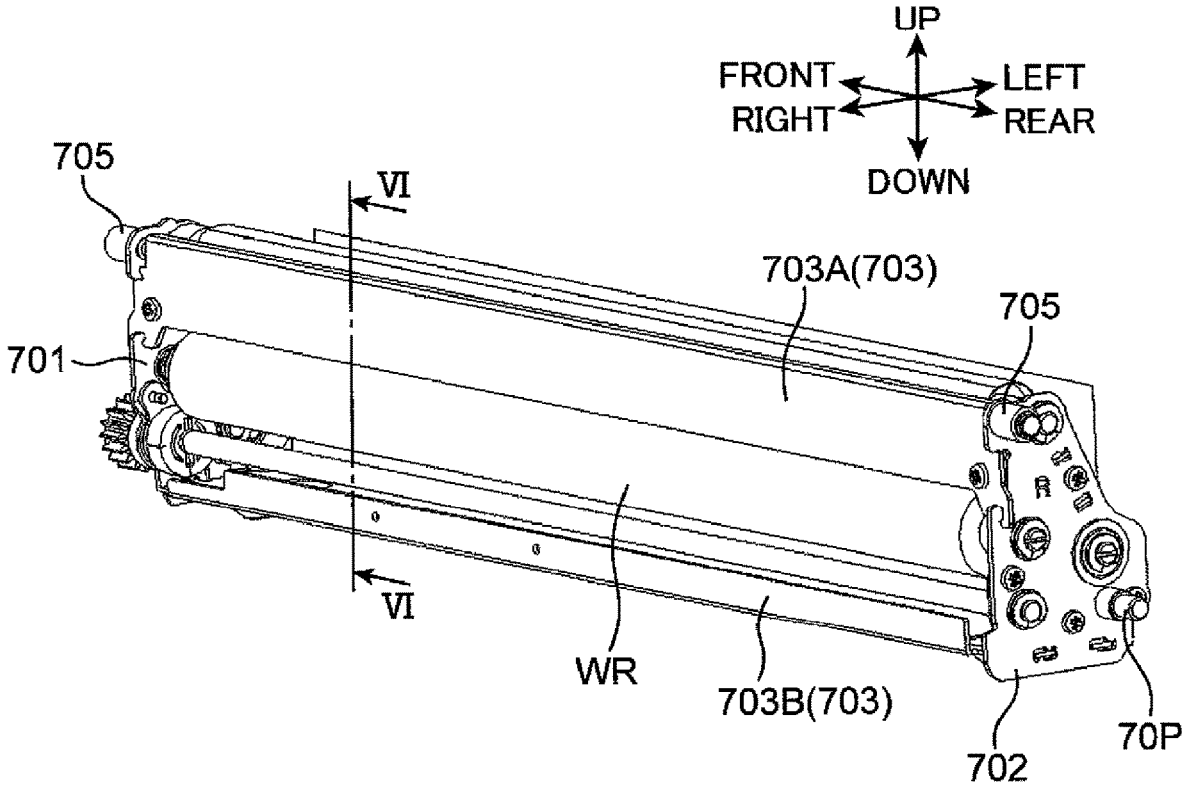
FIG. 5 is a perspective view of the cleaning unit.
Figure 6:
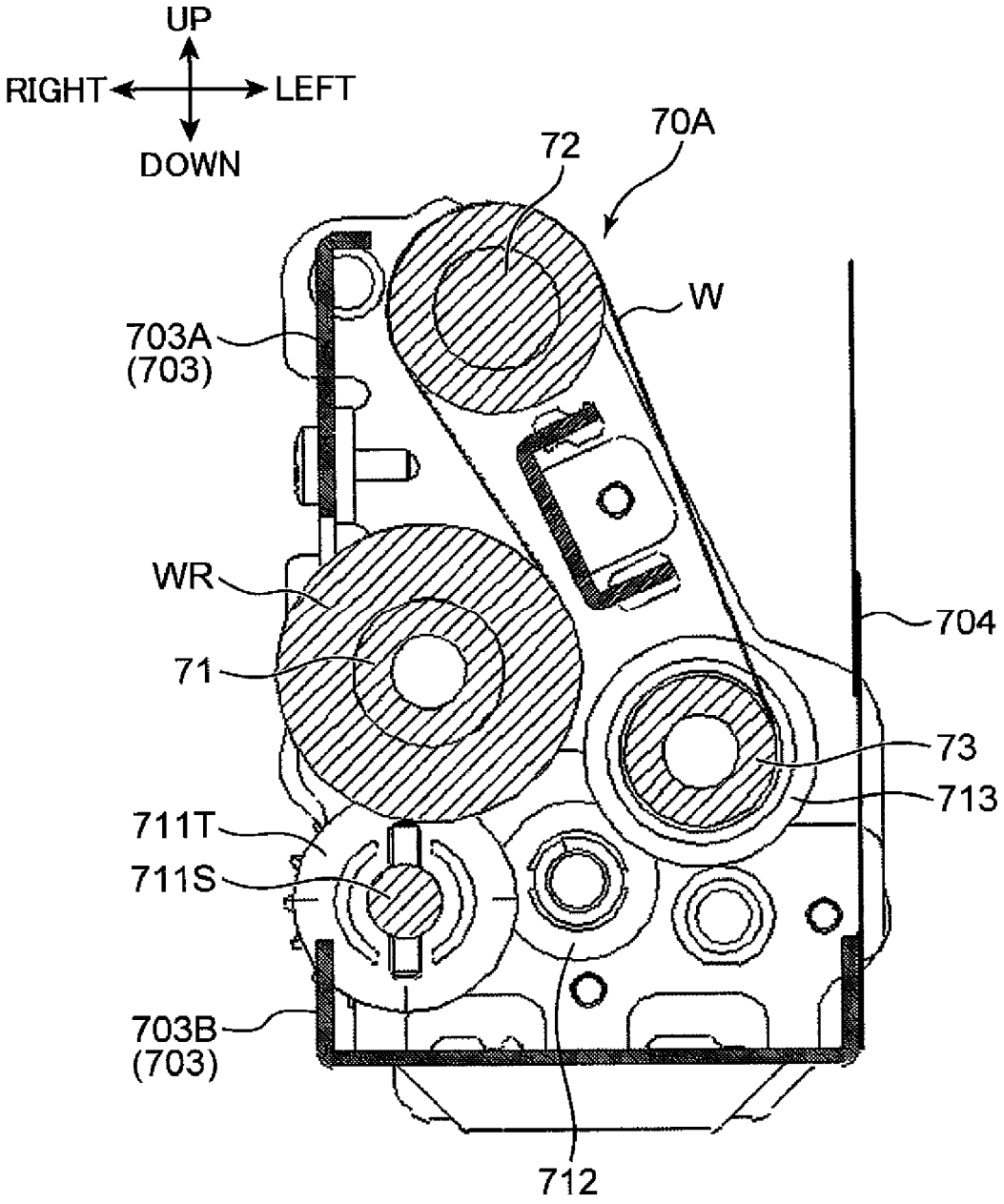
FIG. 6 is a cross-sectional view taken along line VI-VI in FIG. 5.
Figure 7:
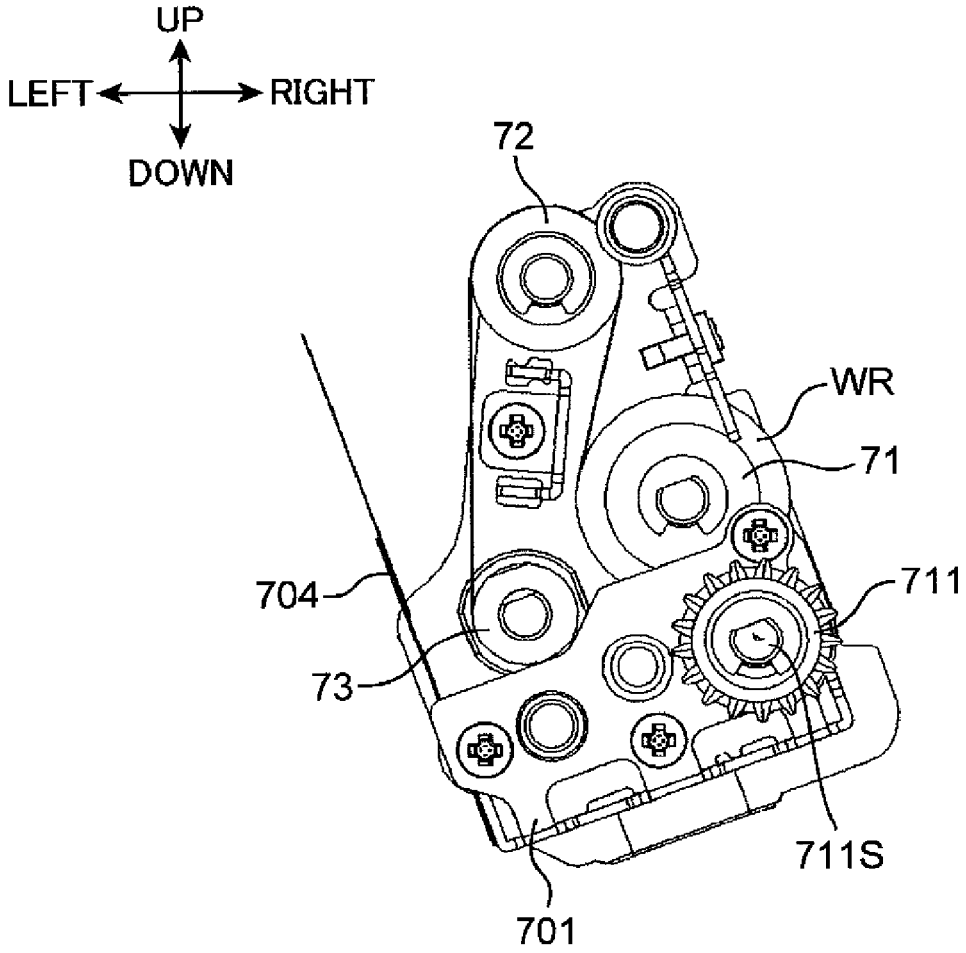
FIG. 7 is a front view of the cleaning unit from which some members making up the cleaning unit are omitted.
Figure 8:
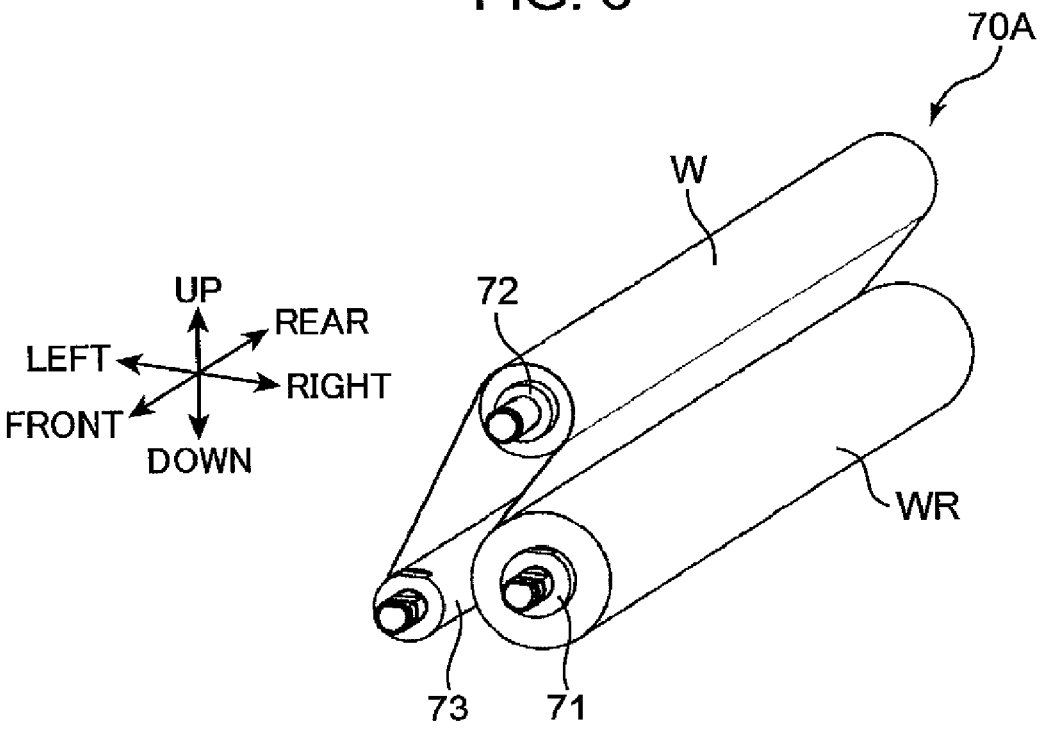
FIG. 8 is a perspective view showing an internal structure of the cleaning unit.

FIGS. 3 to 5 are perspective views of the cleaning unit 70 of the image forming apparatus 1 according to the present embodiment. FIG. 6 is a cross-sectional view of the cleaning unit 70, the cross-sectional view being taken along line VI-VI in FIG. 5. FIG. 7 is a front view of the cleaning unit 70 from which some members making up the cleaning unit 70 are omitted FIG. 8 is a perspective view showing an internal structure (cleaning part 70A) of the cleaning unit 70.

The cleaning unit 70 has a cleaning part 70A and a cleaning housing 70H. The cleaning part 70A has a shape extending along an axial direction of the resist lower roller 32, and is brought into contact with a surface of the resist lower roller 32 from below to clean the surface of the resist lower roller 32.

The cleaning housing 70H supports the cleaning part 70A. The cleaning housing 70H has a front wall 701 and a rear wall 702 (a pair of wall portions), a connection wall 703, a pair of unit fulcrum pins 70P (housing shaft portion), a sheet member 704, and a pair of guide rollers 705. The front wall 701, the rear wall 702, and the connection wall 703 of the cleaning housing 70H are made of a metal material (magnetic material).

The front wall 701 and the rear wall 702 are disposed so as to face each other in the front-rear direction (axial direction of the resist lower roller 32) and support the cleaning part 70A. The connection wall 703 connects the front wall 701 and the rear wall 702 along the front-rear direction. The connection wall 703 has a side wall 703A and a bottom wall 703B (FIGS. 5 and 6). A pair of front and rear ribs 703T are formed on the bottom wall 703B in a protruding manner (see FIGS. 19 and 20).

The pair of unit fulcrum pins 70P are formed on the front wall 701 and the rear wall 702 (the pair of wall portions), respectively, in a protruding manner to protrude from their outer surfaces in the front-rear direction. The unit fulcrum pins 70P are disposed on left lower portions of the front wall 701 and the rear wall 702 respectively. Each unit fulcrum pin 70P has a circular cylindrical shape in two stages where an outer diameter of the unit fulcrum pin 70P decreases toward a distal end portion.

The sheet member 704 is fixed to the bottom wall 703B so as to define a left side surface of the cleaning unit 70 (FIG. 6). The sheet member 704 prevents a collected matter such as paper dust collected by the cleaning unit 70 from scattering toward the belt conveyance unit 40 (FIG. 1).

The pair of guide rollers 705 are supported by the front wall 701 and the rear wall 702 above the unit fulcrum pins 70P, respectively, and each include an outer peripheral surface rotatable around a center axis parallel to the front-rear direction. The guide rollers 705 are disposed on right upper portions of the front wall 701 and the rear wall 702 respectively. The pair of guide rollers 705 has a function of guiding the cleaning unit 70 when the cleaning unit 70 moves to the mounting and removing position, the separation position, and the cleaning position described above.

The cleaning part 70A includes a web W and rollers rotatably supported by the front wall 701 and the rear wall 702, the rollers including a web driven roller 71, a pressing roller 72, and a web drive roller 73 (see FIGS. 6 to 8). The web W is formed of a strip-shaped member having a contact surface capable of being brought into contact with the surface of the resist lower roller 32. The web W is formed of a cloth material such as a nonwoven fabric as an example. In the present embodiment, as shown in FIGS. 6 and 8, a web roll WR, into which the web W is rolled in advance, is fitted on the exterior of the web driven roller 71. Then, a distal end of the web W is caught by an outer peripheral surface of the pressing roller 72 and, thereafter, the distal end of the web W is fixed to an outer peripheral surface of the web drive roller 73. The pressing roller 72 is in contact with a back surface of the web W and presses a front surface of the web W against the resist lower roller 32. When the cleaning unit 70 is disposed at the above-described cleaning position (FIG. 2), the pressing roller 72 is brought into contact with the resist lower roller 32 with the web W sandwiched therebetween. The web driven roller 71 feeds out the web W so as to cause a part of the web W that comes in contact with the resist lower roller 32 to shift, and the web drive roller 73 takes up the web W. As shown in FIG. 5, a state of the web roll WR supported by the web driven roller 71 can be visually recognized from the outside of the cleaning unit 70 through an opening portion formed between the side wall 703A and the bottom wall 703B. Accordingly, it is possible to prevent the cleaning unit 70 which is removed from the apparatus body 10 during use and where a feedable amount of the web W becomes small from being erroneously mounted on the apparatus body 10.

The cleaning unit 70 has a unit input gear 711 (FIG. 4), an interlocking gear 711T, a transmission gear 712, and a drive roller gear 713 (FIG. 6).

The unit input gear 711 is rotatably supported at a lower right end portion of the front wall 701. An input gear shaft 711S of the unit input gear 711 penetrates the front wall 701 and extends to the inside (back side) of the front wall 701. The interlocking gear 711T is fixed to the input gear shaft 711S, and rotates integrally with the unit input gear 711.

The transmission gear 712 is rotatably supported on an inner side of the front wall 701, and engages with the interlocking gear 711T and the drive roller gear 713 respectively. The drive roller gear 713 is a gear fixed to one end portion of the web drive roller 73.

Figure 9:
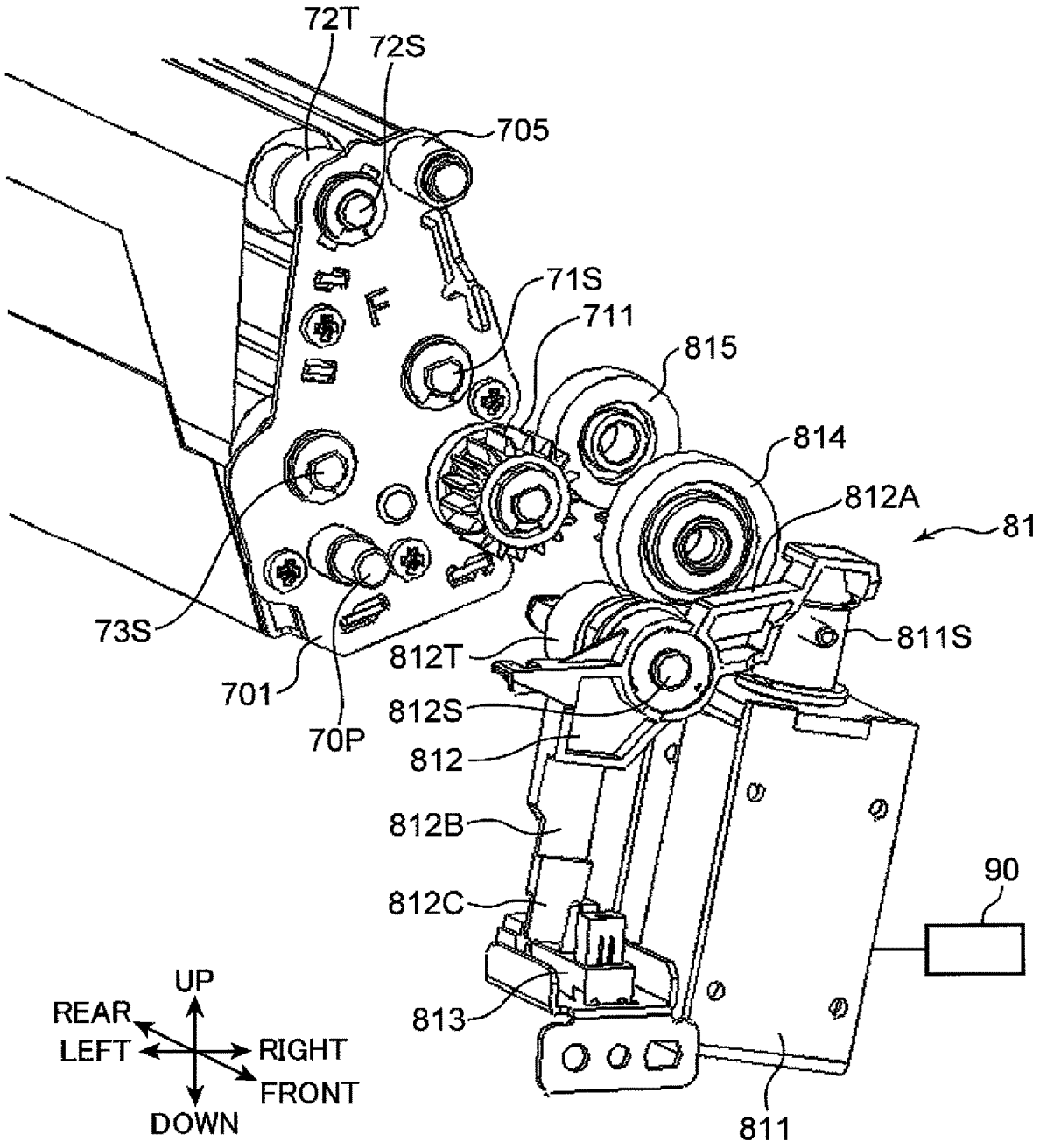
FIG. 9 is a perspective view of the cleaning unit and a web feed-out mechanism.
Figure 10:
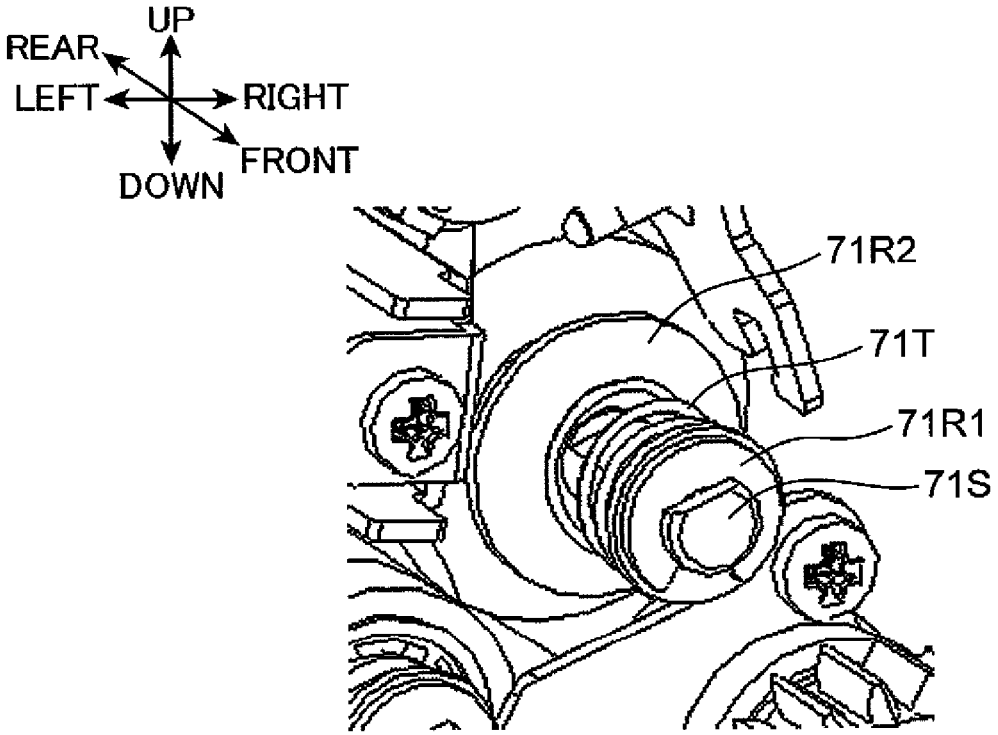
FIG. 10 is an enlarged perspective view of a part of the cleaning unit.
Figure 11:
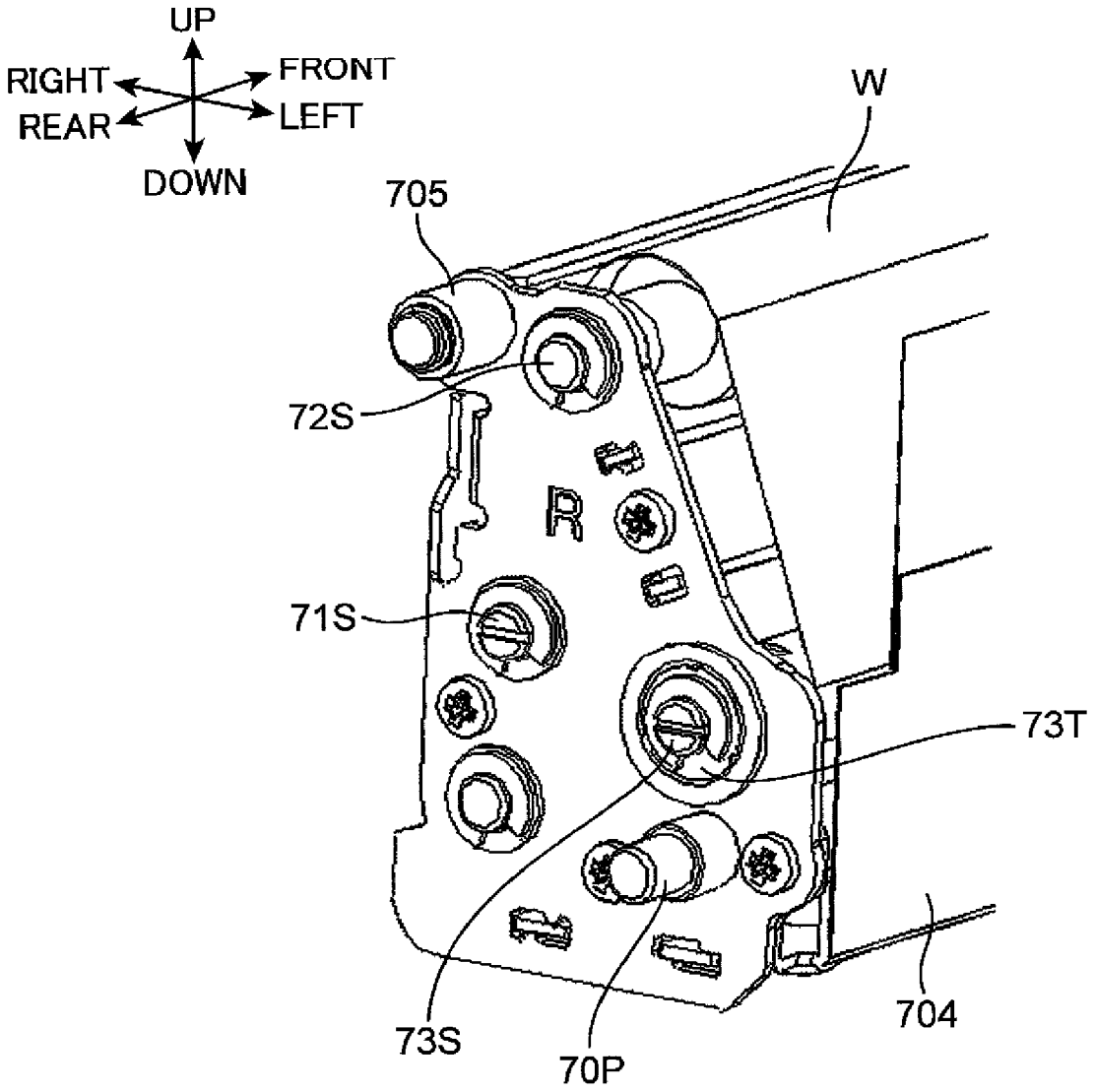
FIG. 11 is an enlarged perspective view of a part of the cleaning unit.

FIG. 9 is a perspective view of the cleaning unit 70 and a web feed-out mechanism 81 of the image forming apparatus 1 according to the present embodiment. FIGS. 10 and 11 are enlarged perspective views of a part of the cleaning unit 70.

The cleaning device 7 further includes the web feed-out mechanism 81 and a controller 90. The web feed-out mechanism 81 is mounted on the apparatus body 10 of the image forming apparatus 1. The web feed-out mechanism 81 has a function of feeding out the web W of the cleaning unit 70. The web feed-out mechanism 81 is connected to the cleaning unit 70 by disposing the cleaning unit 70 at the cleaning position. The web feed-out mechanism 81 has a solenoid 811, a rotary arm 812, a third detection sensor 813, a transmission gear 814, and a transmission gear 815.

Upon receiving an instruction signal from the controller 90, the solenoid 811 generates a drive force for moving the web W. The solenoid 811 includes an extendable and retractable shaft 811S. The extendable and retractable shaft 811S extends and retracts with respect to a body of the solenoid 811. The solenoid 811 is supported by a sheet-metal-made drive frame (not shown) which is disposed inside the apparatus body 10.

The rotary arm 812 is rotatably supported on a shaft 812S (FIG. 9) attached to the drive frame in the apparatus body 10. The shaft 812S is supported by the drive frame such that the shaft 812S is rotatable around a rotation center axis extending in the front-rear direction. The rotary arm 812 has a first arm portion 812A and a second arm portion 812B. The first arm portion 812A extends rightward from the rotation center axis of the rotary arm 812. A distal end portion of the first arm portion 812A is connected to the extendable and retractable shaft 811S. The second arm portion 812B extends toward a side opposite to the first arm portion 812A and downward from the rotation center axis of the rotary arm 812. On a distal end portion (lower end portion) of the second arm portion 812B, a detection piece 812C is disposed. A gear portion 812T which can rotate integrally with the shaft 812S is mounted on a rear end portion of the shaft 812S. Further, the web feed-out mechanism 81 has a first one-way clutch (not shown) and a second one-way clutch (not shown). The first one-way clutch is fixedly mounted in the rotary arm 812 and is fitted on the shaft 812S. The second one-way clutch is fixed to the drive frame in a state where the second one-way clutch is disposed adjacently to the first one-way clutch, and is fitted on the shaft 812S.

The third detection sensor 813 is fixed to a left end portion of a body of the solenoid 811. The third detection sensor 813 is a photo-interrupter (PI) sensor that detects a movement (rotation) of the detection piece 812C. The controller 90 can detect an amount of feed-out of the web roll WR that corresponds to the number of times of detection of movement of the detection piece 812C, the number of times being output from the third detection sensor 813. When the above number of times of detection reaches a number of times preset as a threshold value, the controller 90 causes a display unit (not shown) of the image forming apparatus 1 to display a message that recommends replacement of the cleaning unit 70.

The transmission gear 814 is rotatably supported by the apparatus body 10, and engages with the gear portion 812T. The transmission gear 814 is formed of a two-stage gear. In the same manner, the transmission gear 815 is rotatably supported by the apparatus body 10, and the transmission gear 815 engages with a rear gear portion of the two-stage gear of the transmission gear 814, and engages with the above-described unit input gear 711.

FIG. 9 shows a state where the extendable and retractable shaft 811S comes (retracts) into a body of the solenoid 811. In a state shown in FIG. 9, when the controller 90 inputs an instruction signal to the solenoid 811, the extendable and retractable shaft 811S comes (extends) out of the body of the solenoid 811, and, consequently, the rotary arm 812 rotates around the shaft 812S in a counterclockwise direction in FIG. 9. At this stage of the operation, the rotary arm 812 is rotated relative to the shaft 812S by an action of the above-described first one-way clutch so that there is no possibility that the shaft 812S rotates. In a case of feeding out the web W by a predetermined amount, on the other hand, the controller 90 inputs an instruction signal to the solenoid 811, thus causing the extendable and retractable shaft 811S to retract into the body of the solenoid 811. As a result, the rotary arm 812 rotates around the shaft 812S in a clockwise direction in FIG. 9. At this stage of the operation, the shaft 812S rotates integrally with the rotary arm 812 by a predetermined angle by an action of the above-described first one-way clutch. As a result, a rotational drive force is transmitted from the gear portion 812T fixed to the shaft 812S to the unit input gear 711, via the transmission gear 814 and the transmission gear 815. Then, the rotational drive force is further transmitted to the unit input gear 711, the interlocking gear 711T, the transmission gear 712, and the drive roller gear 713 of the cleaning unit 70. As a result, the web drive roller 73 rotates by a preset rotation angle, and the web W is moved so as to be taken up by the web drive roller 73. As a result, a portion of the contact surface of the web W which faces the resist lower roller 32 changes. The third detection sensor 813 detects the detection piece 812C each time the rotary arm 812 rotates by one reciprocation and hence, it is detected that the unit input gear 711 has rotated and the web W has been moved.

When the web W moves, the controller 90 inputs an instruction signal to the solenoid 811, thereby causing the extendable and retractable shaft 811S to extend again out of the body of the solenoid 811. At this stage of the operation, it is possible to prevent the shaft 812S from rotating in a reverse direction by an action of the above-described second one-way clutch. Further, as shown in FIG. 11, the one-way clutch 73T fitted to the drive roller shaft 73S of the web drive roller 73 works to prevent the web drive roller 73 from rotating in the reverse direction. Thus, every time the controller 90 causes the extendable and retractable shaft 811S to extend and retract, the web W moves toward the web drive roller 73 by a predetermined amount. In this manner, according to the present embodiment, the web W can be fed out from the web roll WR by using a slight stroke of extension and retraction of the extendable and retractable shaft 811S of the solenoid 811. In another embodiment, the web feed-out mechanism 81 may rotatably drive the web driven roller 71 in addition to the web drive roller 73.

As shown in FIG. 9, a pressing roller shaft 72S of the pressing roller 72 is fitted with a torque limiter 72T. There may be a case where clogging of the sheet S occurs in the image forming apparatus 1 in a state where the web W (the pressing roller 72) of the cleaning device 7 is brought into contact with the resist lower roller 32 and the sheet S is sandwiched between the resist upper roller 31 and the resist lower roller 32. In this case, a user attempts to remove the sheet S clogged between the resist upper roller 31 and the resist lower roller 32 by opening a predetermined cover of the apparatus body 10 of the image forming apparatus 1, and by pulling out the sheet S in a direction opposite to a direction indicated by an arrow in FIG. 2. At this stage of the operation, when a force for pulling out the sheet S is transmitted from the resist lower roller 32 to the pressing roller 72, the web W is excessively fed out from the pressing roller 72 toward the web drive roller 73. In the present embodiment, since the torque limiter 72T is mounted on the pressing roller shaft 72S, when a sudden rotational force is applied to the pressing roller 72, the rotation of the pressing roller 72 is locked and hence, feeding out of the web W can be prevented.

As shown in FIG. 10, in the present embodiment, a driven roller shaft 71S of the web driven roller 71 has a brake spring 71T in its compressed form interposed between an E-ring 71R1 and a flange 71R2. From FIG. 10, the front wall 701 shown in FIG. 9 is omitted. The flange 71R2 is a ring-shaped flange fixed to the pressing roller shaft 72S of the pressing roller 72. A rear end portion of the brake spring 71T is in contact with the flange 71R2. A front end portion of the brake spring 71T is in contact with a back surface of the front wall 701. Because of this configuration, a compressive force of the brake spring 71T is applied to the pressing roller 72 via the flange 71R2, thus preventing the pressing roller 72 from rotating unnecessarily. As a result, despite the controller 90 not exerting control over the solenoid 811, the web W being fed out from the pressing roller 72 is prevented.

The movement mechanism 75 (FIG. 2) can move the cleaning unit 70 among the cleaning position (FIG. 2), the mounting and removing position (FIG. 24) below the cleaning position, and the separation position (FIG. 26) located between the cleaning position and the mounting and removing position. At the cleaning position, the movement mechanism 75 allows the cleaning part 70A to come in contact with the resist lower roller 32. At the mounting and removing position, the movement mechanism 75 allows the cleaning part 70A to be disposed below the resist lower roller 32 in a separated manner and allows the cleaning unit 70 to be mounted and removed on and from the apparatus body 10. At the separation position, the cleaning part 70A is disposed below the resist lower roller 32 in a separated manner, and the cleaning unit 70 is disconnected from the web feed-out mechanism 81.

Figure 12:
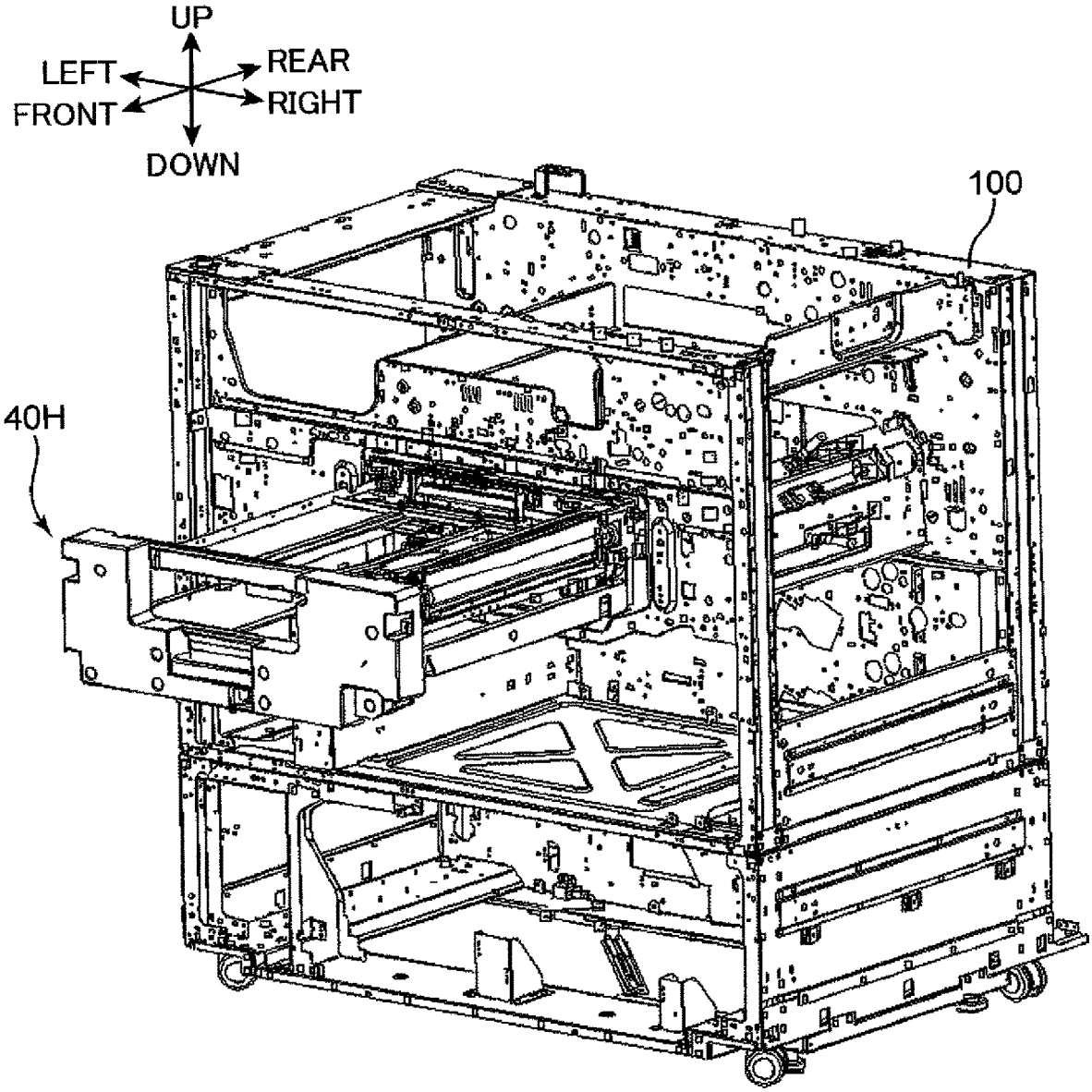
FIG. 12 is a perspective view showing a state where a conveyance unit frame is removed from a body frame making up an apparatus body of the image forming apparatus according to the embodiment of the present disclosure.
Figure 13:
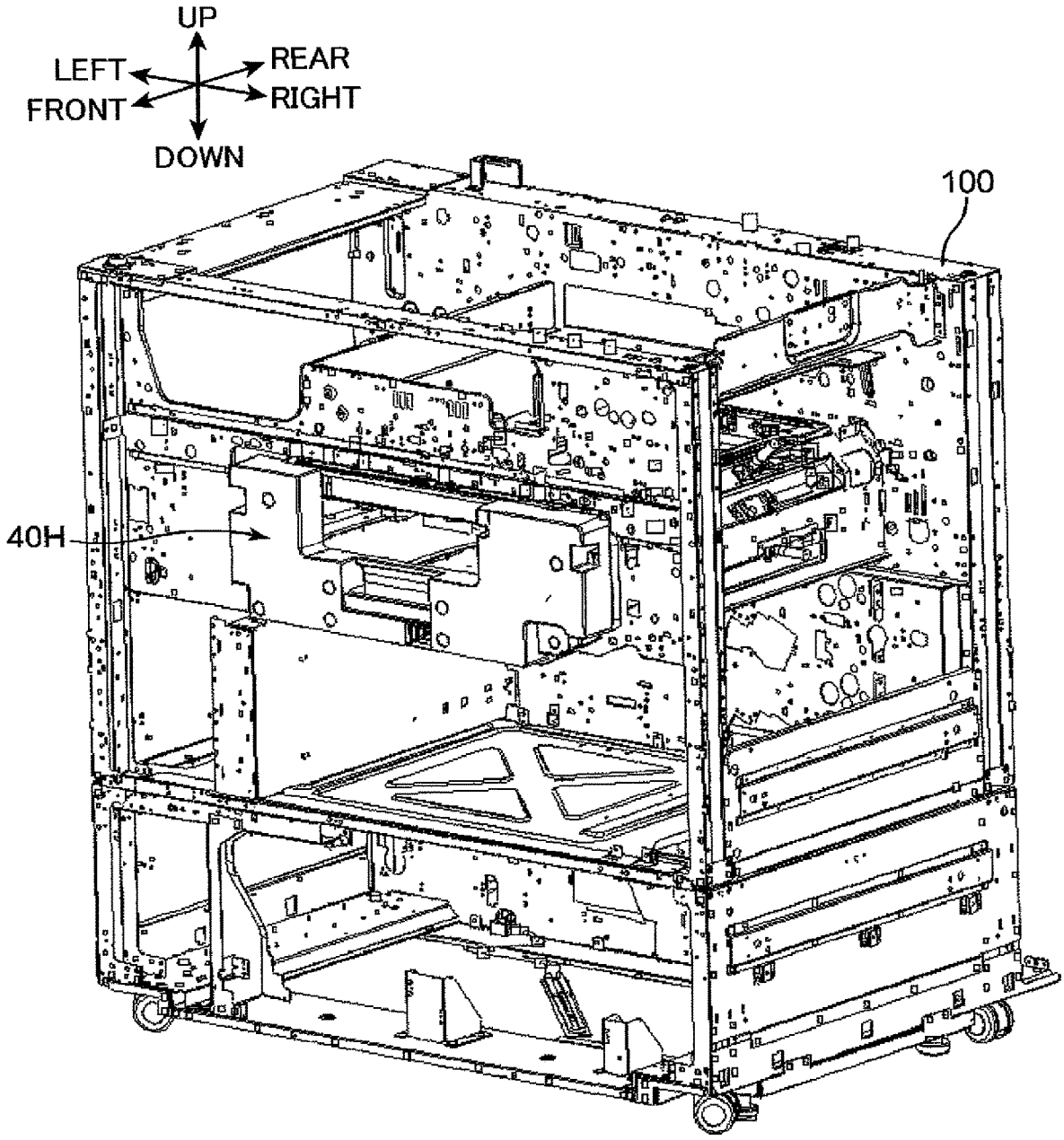
FIG. 13 is a perspective view showing a state where the conveyance unit frame is mounted on the body frame.
Figure 14:
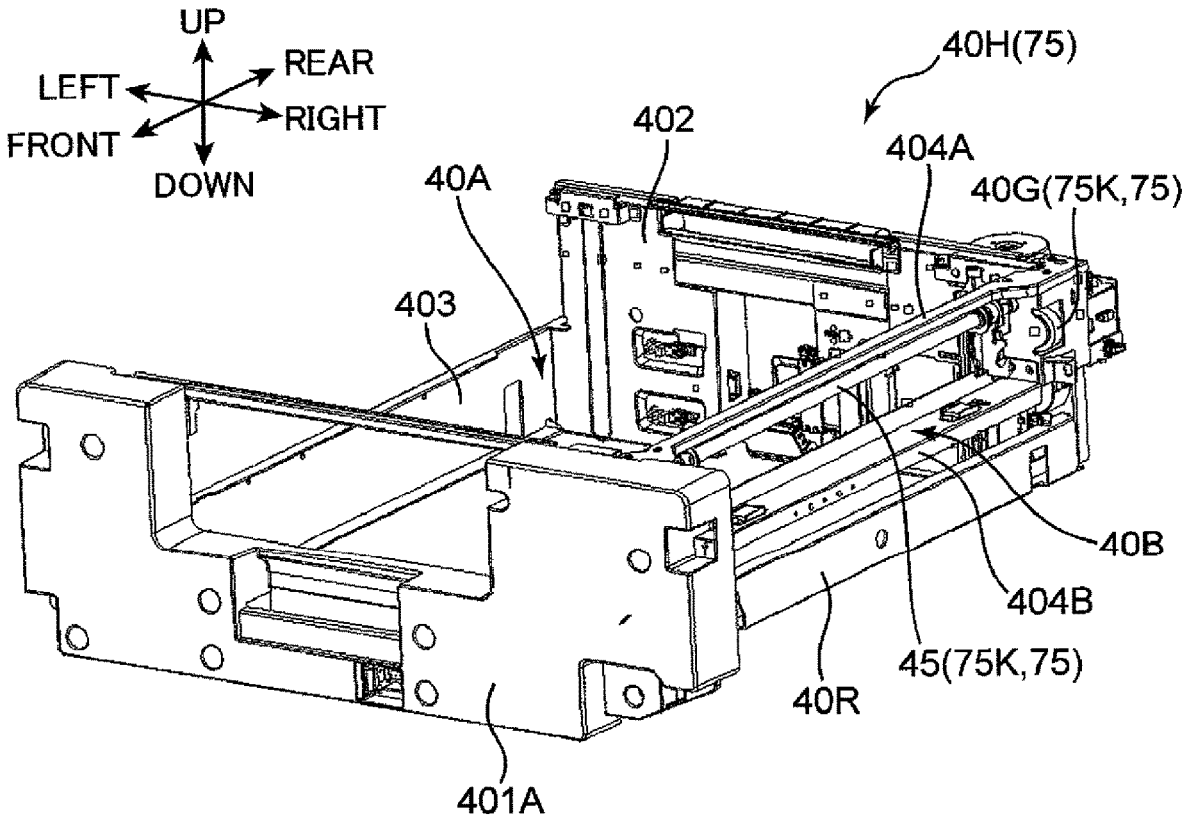
FIG. 14 is a perspective view of the conveyance unit frame.
Figure 15:
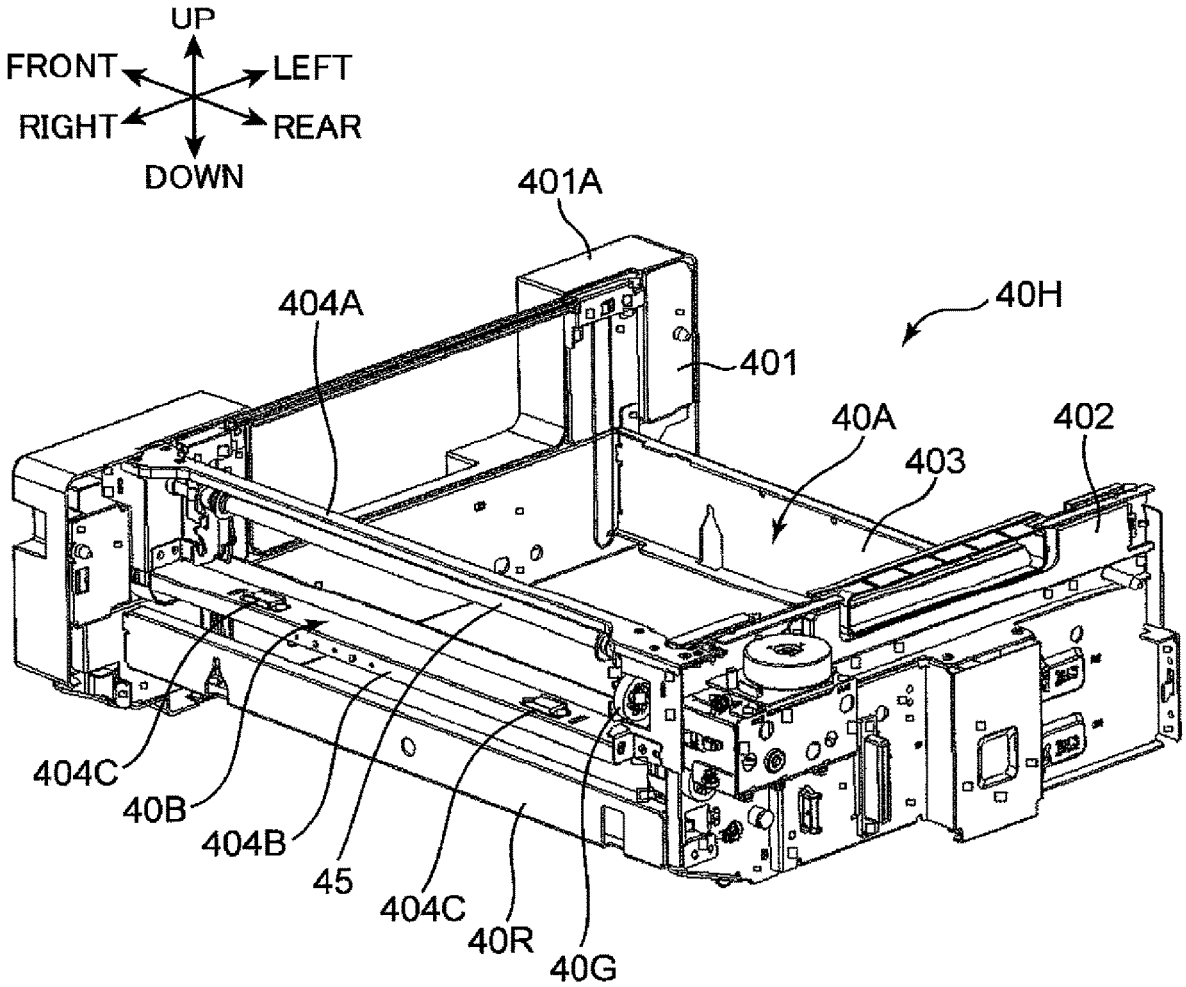
FIG. 15 is a perspective view of the conveyance unit frame.

FIG. 12 is a perspective view showing a state where a conveyance unit frame 40H is removed from a body frame 100 making up the apparatus body 10 of the image forming apparatus 1 according to the present embodiment. FIG. 13 is a perspective view showing a state where the conveyance unit frame 40H is mounted in the body frame 100. FIGS. 14 and 15 are perspective views of the conveyance unit frame 40H.

The belt conveyance unit 40 (processing unit) shown in FIG. 1 further includes the conveyance unit frame 40H. The conveyance unit frame 40H integrally supports the conveyance belt 41, the first support roller 421, the second support roller 422, the third support roller 423, the pair of fourth support rollers 424, and the suction unit 43. The conveyance unit frame 40H can be mounted in the body frame 100 of the apparatus body 10 in a first direction (rearward direction) parallel to the front-rear direction (the axial direction of the resist lower roller 32), and can be removed from the body frame 100 along a second direction (frontward direction) opposite to the first direction.

As shown in FIGS. 14 and 15, the conveyance unit frame 40H includes a front frame 401, a rear frame 402, a left frame 403, a first right frame 404A, a second right frame 404B, a pair of front and rear magnets 404C (magnetic members), and a pair of left and right rail portions 40R.

The front frame 401 is a frame disposed on a front surface portion of the conveyance unit frame 40H. As shown in FIGS. 14 and 15, the front frame 401 is fitted with a front cover 401A. The front cover 401A forms a part of the front surface portion of the apparatus body 10. The rear frame 402 is a frame disposed on a rear surface portion of the conveyance unit frame 40H, and is disposed so as to face the front frame 401 in the front-rear direction. The left frame 403 is disposed on a left end portion of the conveyance unit frame 40H, and connects the front frame 401 and the rear frame 402 to each other along the front-rear direction. The first right frame 404A and the second right frame 404B are disposed on the right end portion of the conveyance unit frame 40H, and connect the front frame 401 and the rear frame 402 to each other along the front-rear direction. The first right frame 404A is disposed along an upper surface portion of the conveyance unit frame 40H, and the second right frame 404B is disposed below the first right frame 404A. Both end portions of the first right frame 404A and both end portions of the second right frame 404B in the front-rear direction are respectively connected to each other along a vertical direction by a pair of side plates (not shown) which is disposed inside the front frame 401 and the rear frame 402. As a result, a rectangular frame structure is formed by the first right frame 404A, the second right frame 404B, and the above-described pair of side plates. The left and right rail portions 40R which form a pair are rail portions for allowing the conveyance unit frame 40H to move in a slidable manner in the front-rear direction with respect to the body frame 100. In FIGS. 14 and 15, out of the left and right rail portions 40R, only the right rail portion 40R is shown. However, the same rail portion 40R is disposed also on the left end portion of the conveyance unit frame 40H. The pair of magnets 404C are magnets disposed on an upper surface portion of the second right frame 404B at intervals in the front-rear direction. The pair of magnets 404C has a function of holding the cleaning unit 70.

As shown in FIGS. 14 and 15, a conveyance unit mounting portion 40A is formed on the conveyance unit frame 40H such that the conveyance unit mounting portion 40A is located left with respect to the first right frame 404A and the second right frame 404B. The conveyance belt 41, the first support roller 421, the second support roller 422, the third support roller 423, the pair of fourth support rollers 424, the suction unit 43, and the like are disposed in the conveyance unit mounting portion 40A. In a space between the first right frame 404A and the second right frame 404B, on the other hand, a cleaning unit mounting portion 40B (unit mounting portion) is disposed. The cleaning unit mounting portion 40B allows the above-described cleaning unit 70 disposed at the mounting and removing position to be mounted on the cleaning unit mounting portion 40B, and houses the cleaning unit 70. The cleaning unit mounting portion 40B forms a part of the movement mechanism 75.

Figure 16:
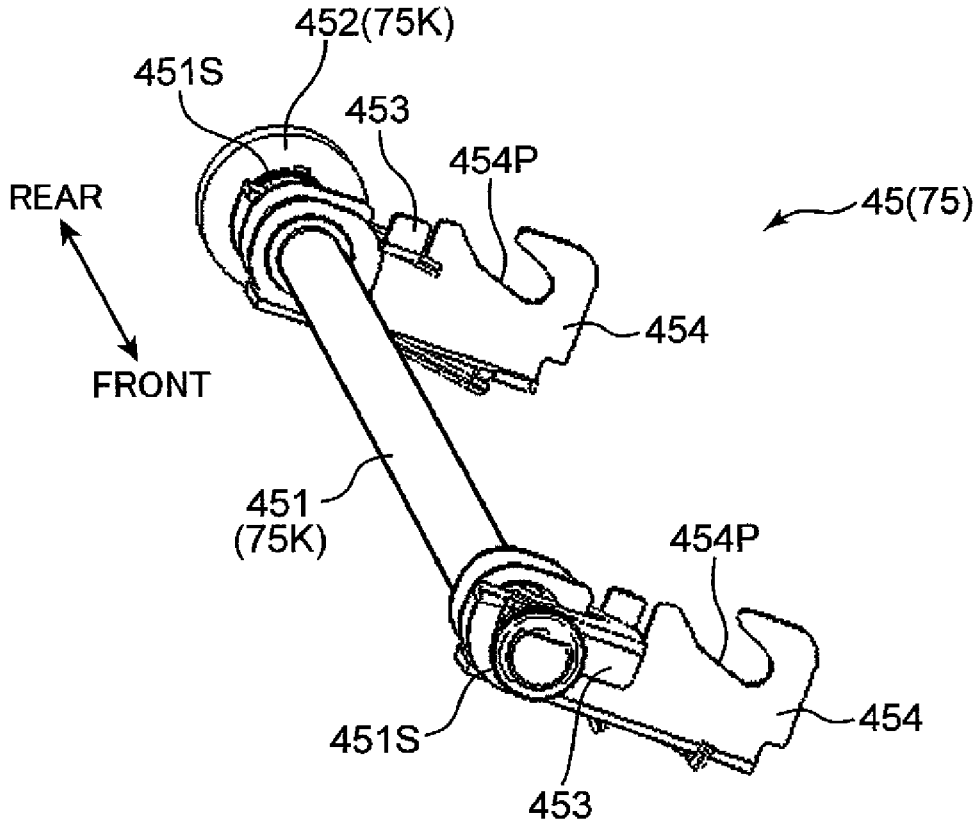
FIG. 16 is a perspective view of a cleaning unit rotating unit of the conveyance unit frame.
Figure 17:
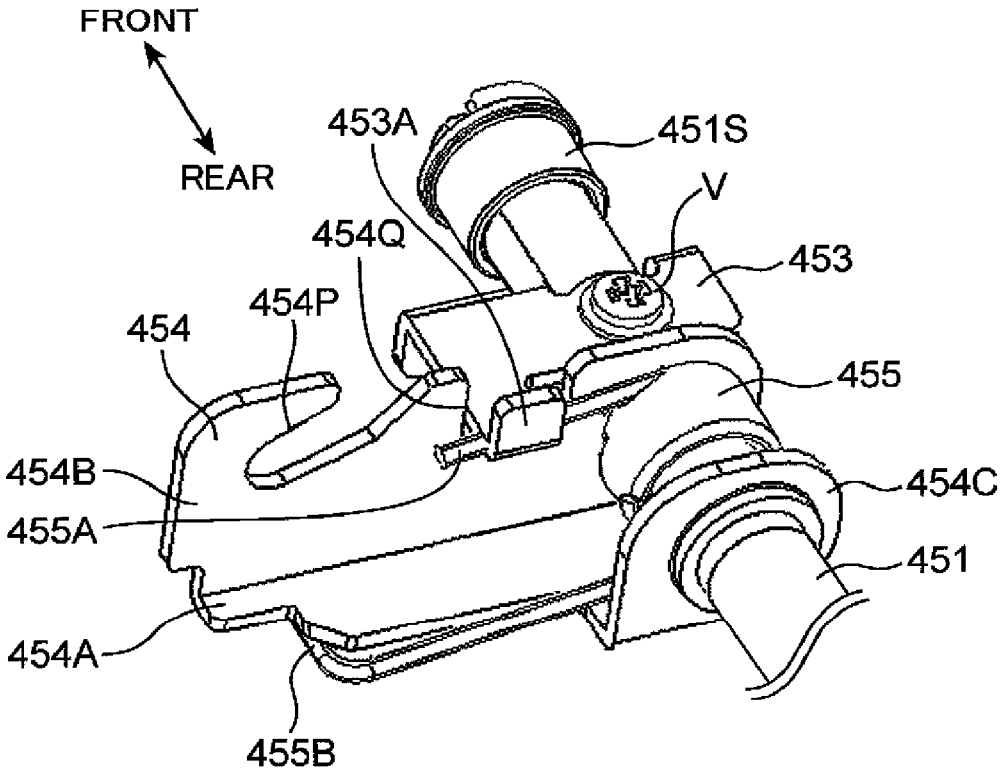
FIG. 17 is an enlarged perspective view of a part of the cleaning unit rotating unit of the conveyance unit frame.
Figure 18:
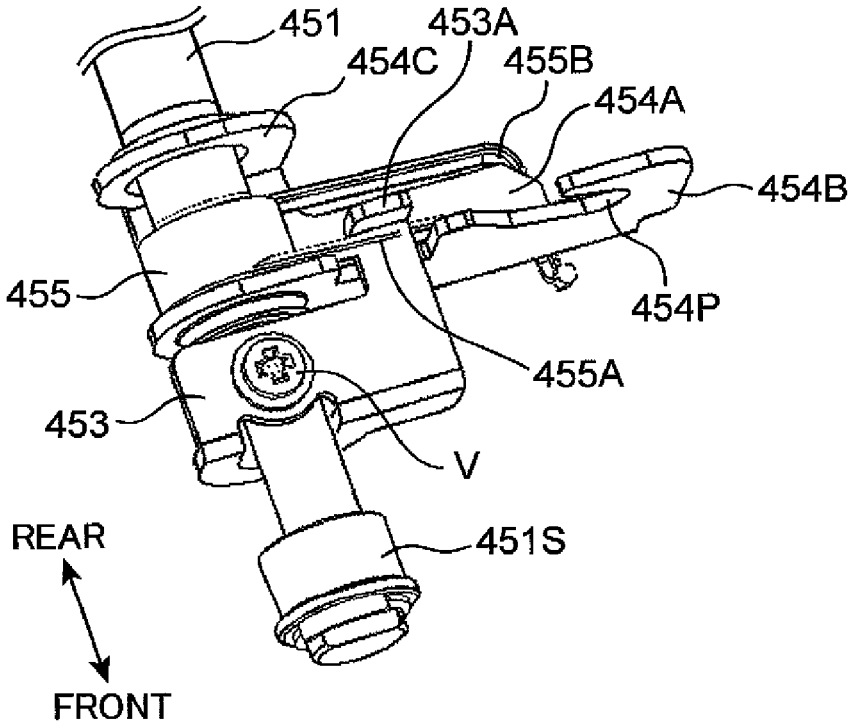
FIG. 18 is an enlarged perspective view of a part of the cleaning unit rotating unit of the conveyance unit frame.

Further, the conveyance unit frame 40H has a cleaning unit rotating unit 45 and a rotation input gear 40G. FIG. 16 is a perspective view of the cleaning unit rotating unit 45 of the conveyance unit frame 40H according to the present embodiment. FIGS. 17 and 18 are enlarged perspective views of a part of the cleaning unit rotating unit 45.

As shown in FIGS. 14 and 15, the cleaning unit rotating unit 45 is supported by the pair of side plates just below the first right frame 404A. As shown in FIG. 16, the cleaning unit rotating unit 45 includes a rotary shaft 451, a pair of front and rear bearings 451S, a rotary gear 452, a pair of front and rear lever support portions 453, a pair of front and rear rotary levers 454 (support members), and a pair of front and rear coil springs 455.

The rotary shaft 451 is rotatably supported by the pair of side plates by way of the pair of front and rear bearings 451S. The rotary shaft 451 extends along the front-rear direction (the axial direction of the resist lower roller 32) and forms a center axis (first center axis) in the rotation of the pair of rotary levers 454. The rotary gear 452 is a gear fixed to a rear end portion of the rotary shaft 451, and engages with the rotation input gear 40G.

The pair of front and rear rotary levers 454 are disposed in the cleaning unit mounting portion 40B, and can support the cleaning housing 70H of the cleaning unit 70 such that the rotary levers 454 sandwich the cleaning housing 70H from both sides in the front-rear direction (the axial direction of the resist lower roller 32). As shown in FIGS. 17 and 18, each rotary lever 454 has a lever bottom portion 454A, a first lever side portion 454B, and a second lever side portion 454C. The lever bottom portion 454A includes a plane parallel to an axial direction of the rotary shaft 451, and extends in a radial direction of the rotary shaft 451. The first lever side portion 454B and the second lever side portion 454C are wall portions erected respectively from front and rear side edges of the lever bottom portion 454A, and are each disposed so as to be orthogonal to the axial direction of the rotary shaft 451. The second lever side portion 454C is of a substantially rectangular shape slightly larger than an outline of the rotary shaft 451, and the first lever side portion 454B extends from the rotary shaft 451 in the radial direction to be longer than the second lever side portion 454C.

A hole, through which the rotary shaft 451 is inserted, is bored on the first lever side portion 454B and on the second lever side portion 454C as well. As a result, the rotary lever 454 is rotatably supported by the rotary shaft 451.

Further, a pin receiving portion 454P (pivotally support portion) and a cutout portion 454Q are formed on the first lever side portion 454B. The pin receiving portion 454P has a shape created by cutting an elongated-hole-like shape out of the first lever side portion 454B from its side edge. The pin receiving portion 454P has a function of receiving the unit fulcrum pin 70P (FIGS. 3 and 4) of the cleaning unit 70 along a direction orthogonal to the front-rear direction (the axial direction of the resist lower roller 32) and rotatably supporting the unit fulcrum pin 70P. Between the pin receiving portion 454P and the rotary shaft 451, the cutout portion 454Q has a shape created by cutting a substantially rectangular shape out of the first lever side portion 454B from its side edge.

The pair of front and rear lever support portions 453 are fixed to the rotary shaft 451, using screws V, such that the front and rear lever support portions 453 hold the pair of rotary levers 454, respectively. Each lever support portion 453 has a support protruding portion 453A disposed so as to extend in the front-rear direction in the cutout portion 454Q. A distal end portion of the support protruding portion 453A has a shape that is bent so as to be orthogonal to a body of the lever support portion 453.

As shown in FIGS. 17 and 18, each of the pair of front and rear coil springs 455 is disposed so as to be interposed between the lever support portion 453 and the rotary lever 454. Specifically, each coil spring 455 has a first spring end portion 455A and a second spring end portion 455B. The first spring end portion 455A is locked to an upper surface portion of the support protruding portion 453A. The second spring end portion 455B is locked to a lower surface portion of the lever bottom portion 454A of the rotary lever 454. As a result, each coil spring 455 is interposed elastically between the rotary lever 454 and the lever support portion 453 so that the rotary lever 454 is allowed to rotate around the center axis of the rotary shaft 451 within a predetermined allowable angle range, relative to the lever support portion 453. When no external force is applied to the lever support portion 453 and to the rotary lever 454, an elastic force of the coil spring 455 regulates relative positions of the lever support portion 453 and the rotary lever 454 to each other in a circumferential direction (rotation direction). In other words, in FIGS. 17 and 18, when the position of the rotary lever 454 is fixed, the lever support portion 453 and the rotary shaft 451 are allowed to rotate relative to the rotary lever 454 while causing the coil spring 455 to deform elastically.

Further, the cleaning device 7 has a rotation drive unit 75K. The rotation drive unit 75K forms a part of the movement mechanism 75. In a state where the pair of unit fulcrum pins 70P are pivotally supported on the pair of pin receiving portions 454P, the rotation drive unit 75K causes the pair of rotary levers 454 to rotate around the center axis of the rotary shaft 451 so that the cleaning unit 70 moves between the cleaning position and the mounting and removing position. The center axis is disposed above the pin receiving portion 454P in FIG. 2. Further, the rotation drive unit 75K rotates the pair of rotary levers 454 while allowing the pair of unit fulcrum pins 70P to rotate relative to the pair of pin receiving portions 454P such that the cleaning unit 70 maintains an orientation where the cleaning part 70A (web W) of the cleaning unit 70 faces upward.

The rotation drive unit 75K has a unit driving unit 80 (FIG. 2), in addition to the above cleaning unit rotating unit 45. The unit driving unit 80 generates a drive force for rotating the rotary shaft 451 of the cleaning unit rotating unit 45 around the center axis of the rotary shaft 451.

Figure 24:
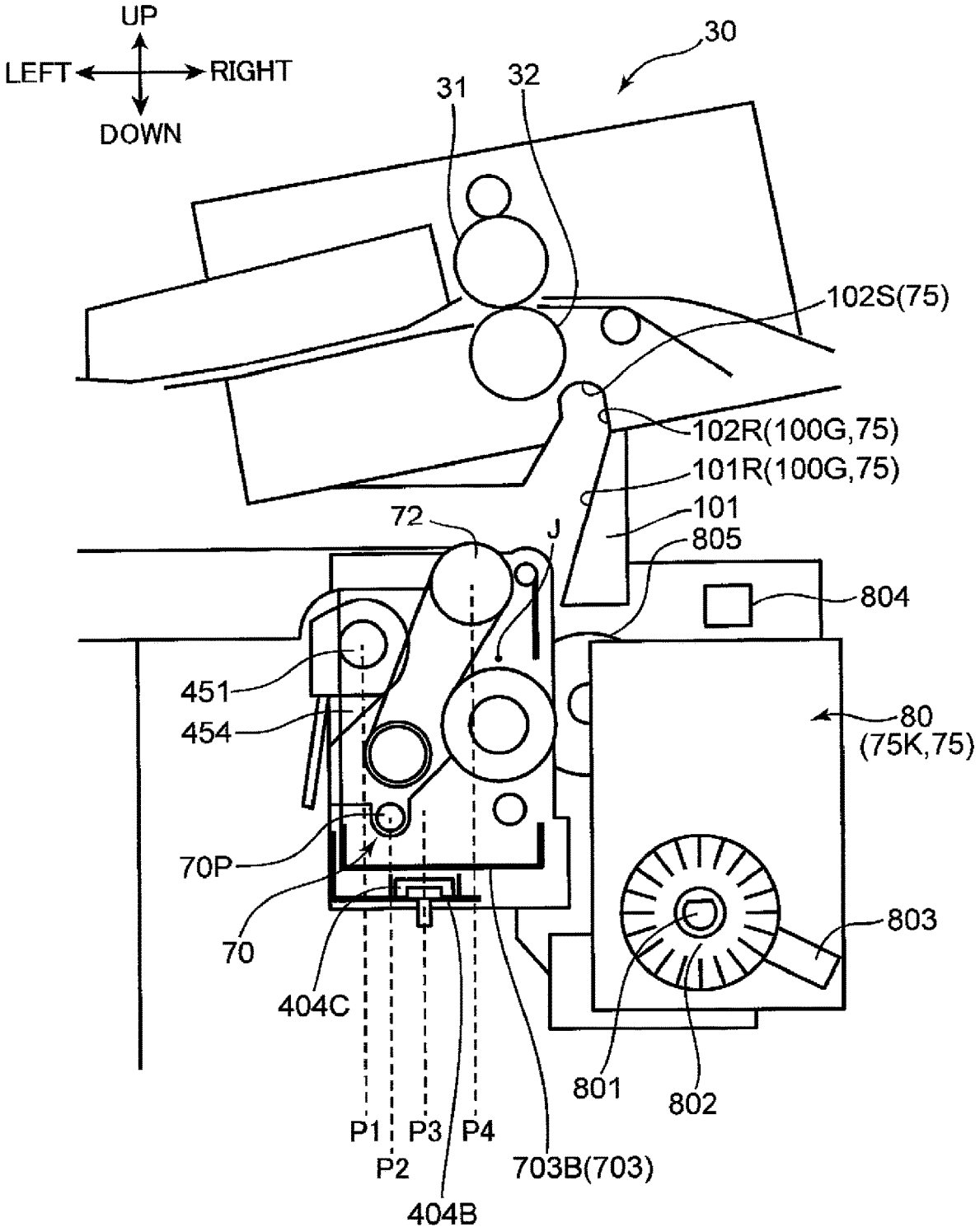
FIG. 24 is a cross-sectional view of the pair of resist rollers, the cleaning unit, and their surroundings of the image forming apparatus according to the embodiment of the present disclosure, showing a state where the cleaning unit is disposed at a mounting and removing position.

As shown in FIG. 2, the unit driving unit 80 has a motor (not shown) including a drive motor output shaft 801, a pulse plate 802, a first detection sensor 803, a second detection sensor 804, and a unit drive output gear 805 (FIG. 24). Driving and rotation of the motor is controlled by the above controller 90.

The pulse plate 802 is fixed to the drive motor output shaft 801, and rotates integrally with the drive motor output shaft 801. The first detection sensor 803 detects a rotation amount of the pulse plate 802. Specifically, the first detection sensor 803 includes a light emitting part for emitting detection light, and a light receiving part for receiving the detection light. A plurality of slits which open at intervals along the rotation direction of the pulse plate 802 are formed in the pulse plate 802. As the pulse plate 802 rotates, the detection light blocked by the pulse plate 802 leaks through the slits to create a waveform of the detection light, and the light receiving part outputs a signal corresponding to the waveform, to the controller 90. Through this process, an amount of rotation of the drive motor output shaft 801 (the pair of rotary levers 454) is detected.

The second detection sensor 804 is formed of a publicly known PI sensor, and detects that the cleaning unit 70 is disposed at the cleaning position shown in FIG. 2. In the present embodiment, when a part of the cleaning housing 70H of the cleaning unit 70 enters between the light emitting part and the light receiving part of the second detection sensor 804, the second detection sensor 804 detects the cleaning unit 70.

The unit drive output gear 805 transmits a rotational drive force generated by the motor of the unit driving unit 80 to the rotation input gear 40G of the cleaning unit rotating unit 45. In the present embodiment, when the conveyance unit frame 40H is mounted on the body frame 100, the rotation input gear 40G and the unit drive output gear 805 engage with each other, and a rotational drive force can be transmitted.

Figure 19:
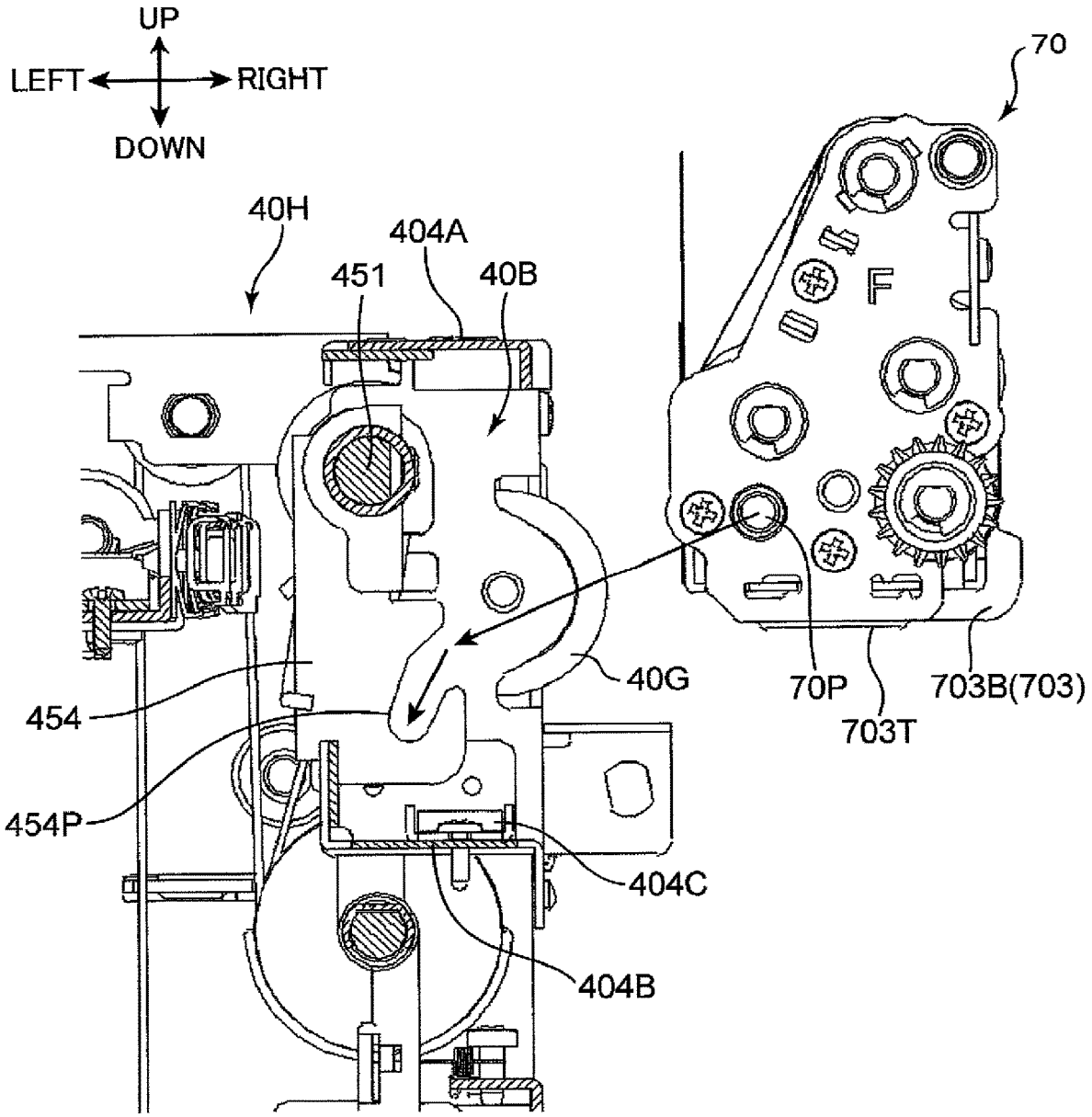
FIG. 19 is a cross-sectional view showing a state where the cleaning unit is about to be mounted on the conveyance unit frame.
Figure 20:
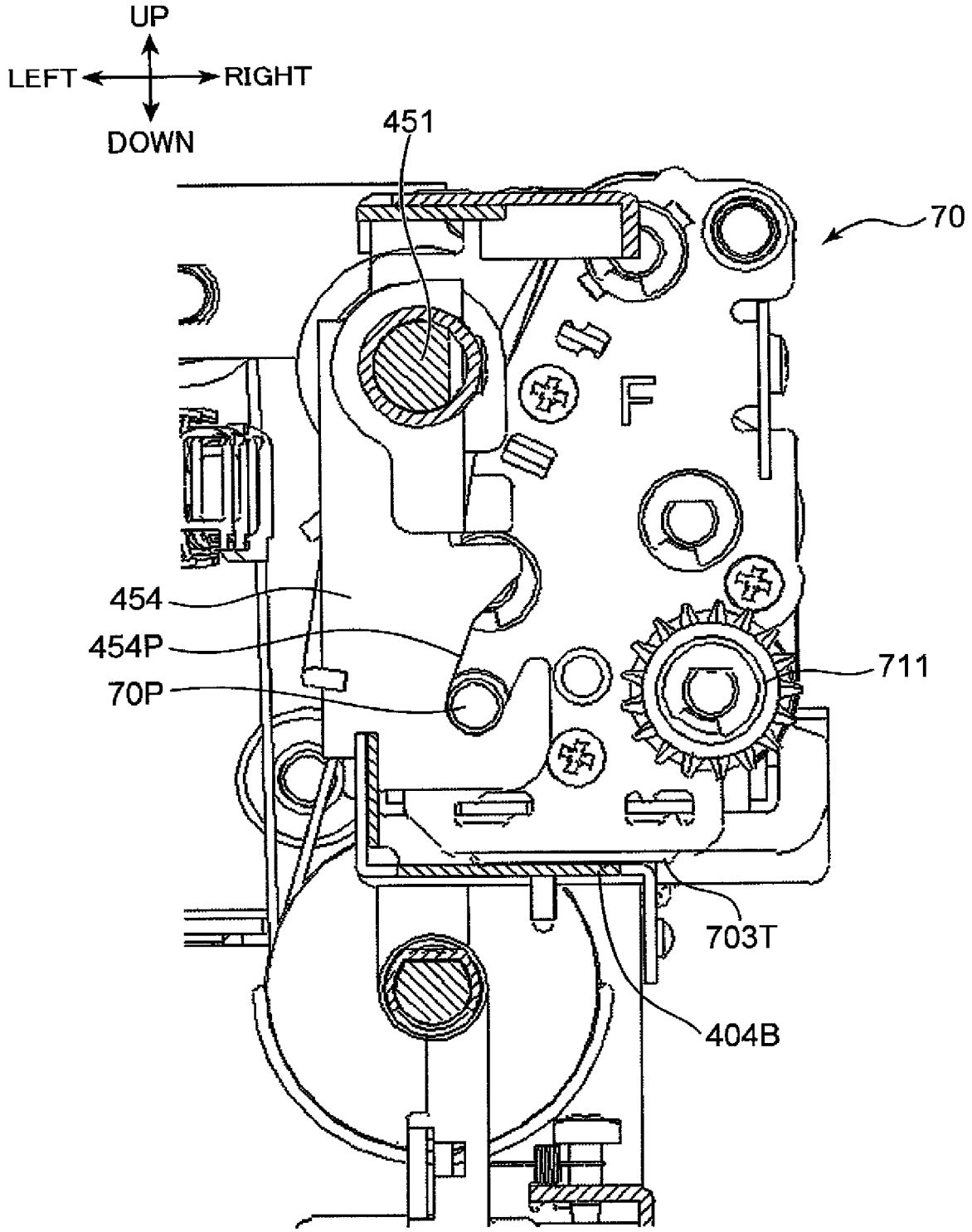
FIG. 20 is a cross-sectional view showing a state where the cleaning unit is mounted on the conveyance unit frame.
Figure 21:
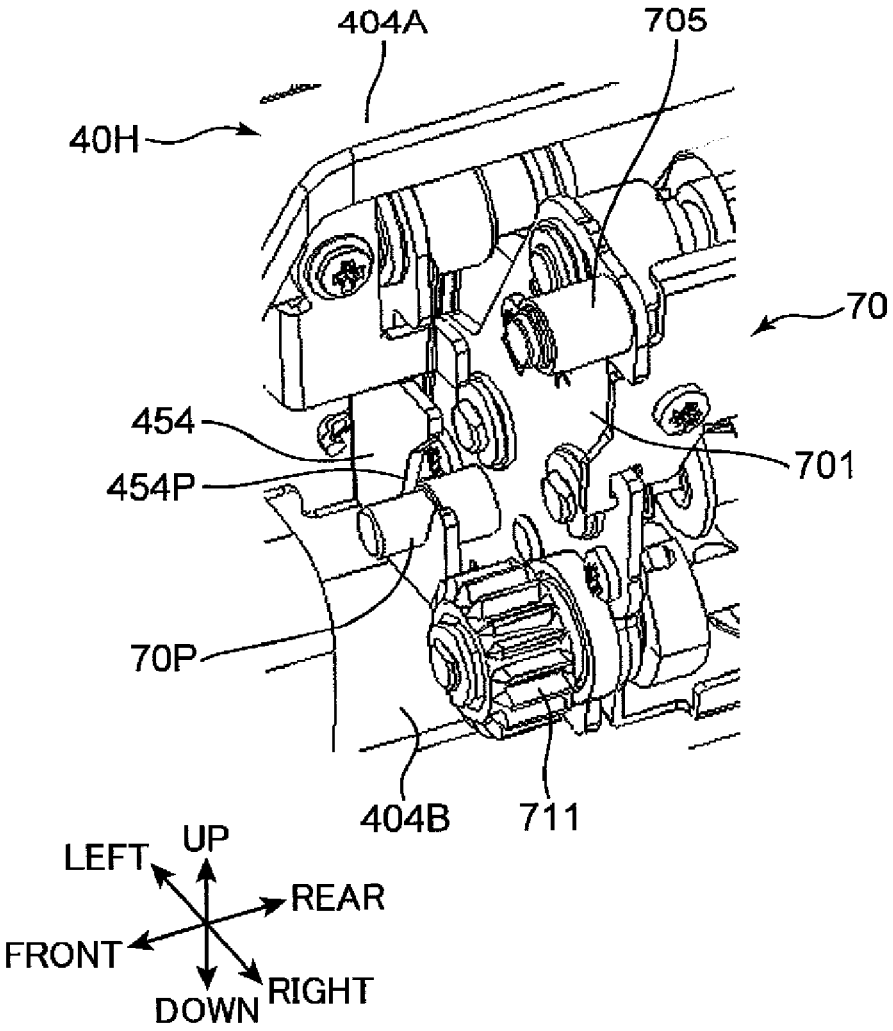
FIG. 21 is an enlarged perspective view showing a state where the cleaning unit is mounted on the conveyance unit frame.
Figure 22:
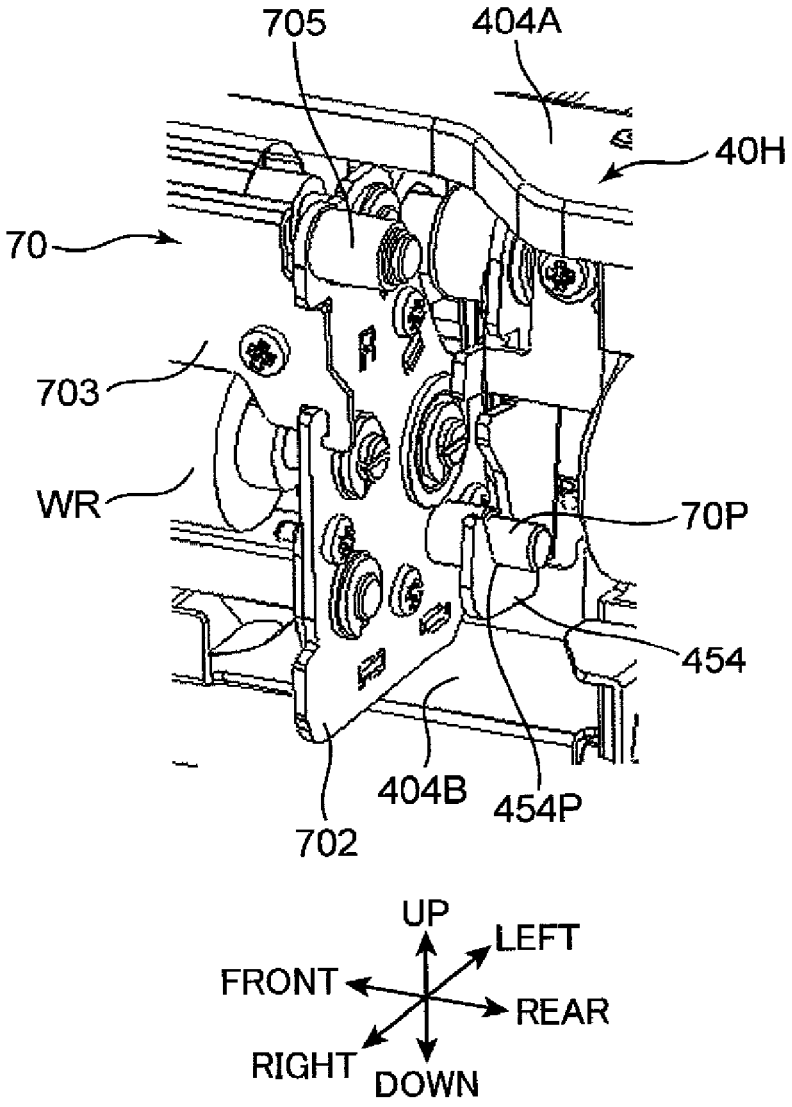
FIG. 22 is an enlarged perspective view showing a state where the cleaning unit is mounted on the conveyance unit frame.
Figure 23:
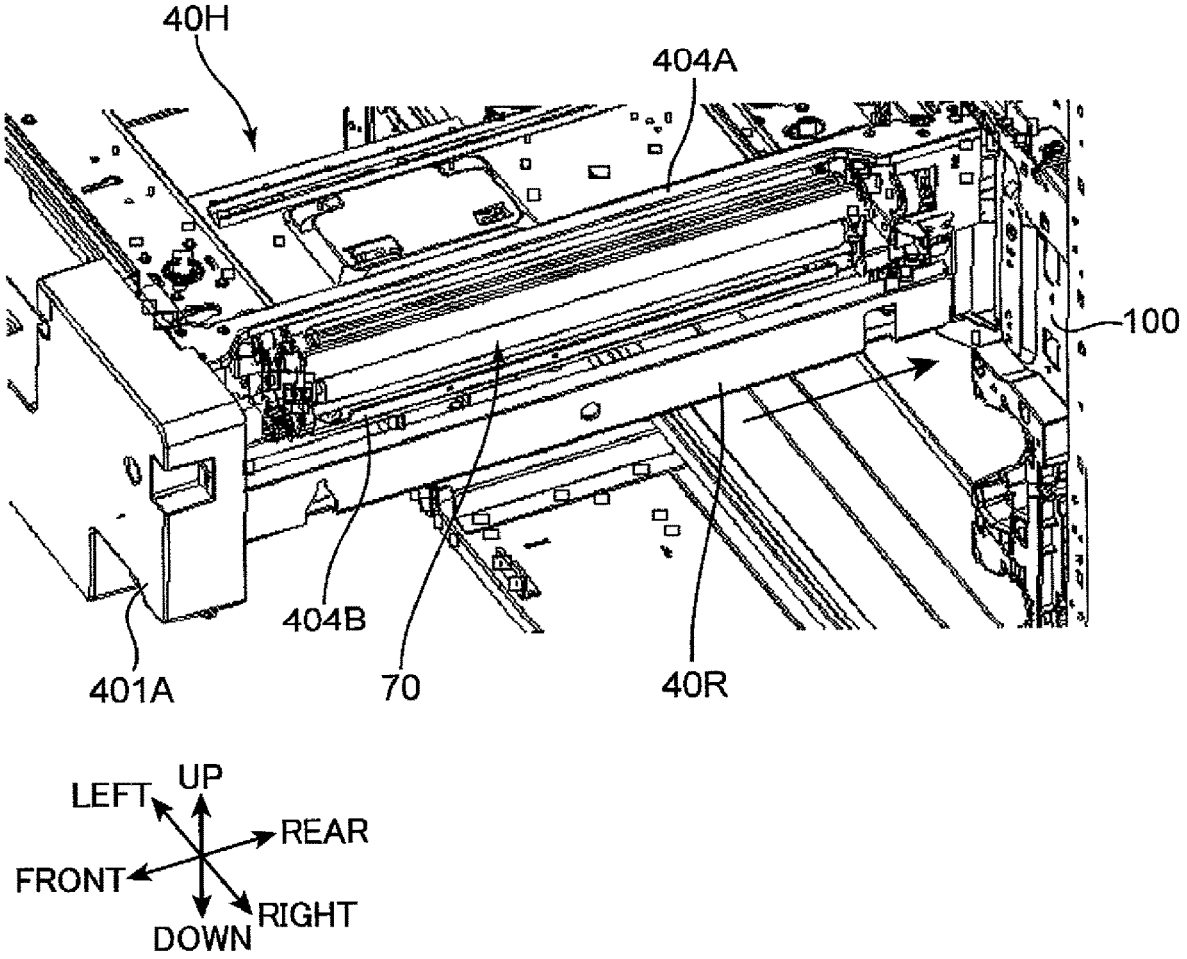
FIG. 23 is a perspective view showing a state where the cleaning unit is mounted on the conveyance unit frame.
Figure 25:
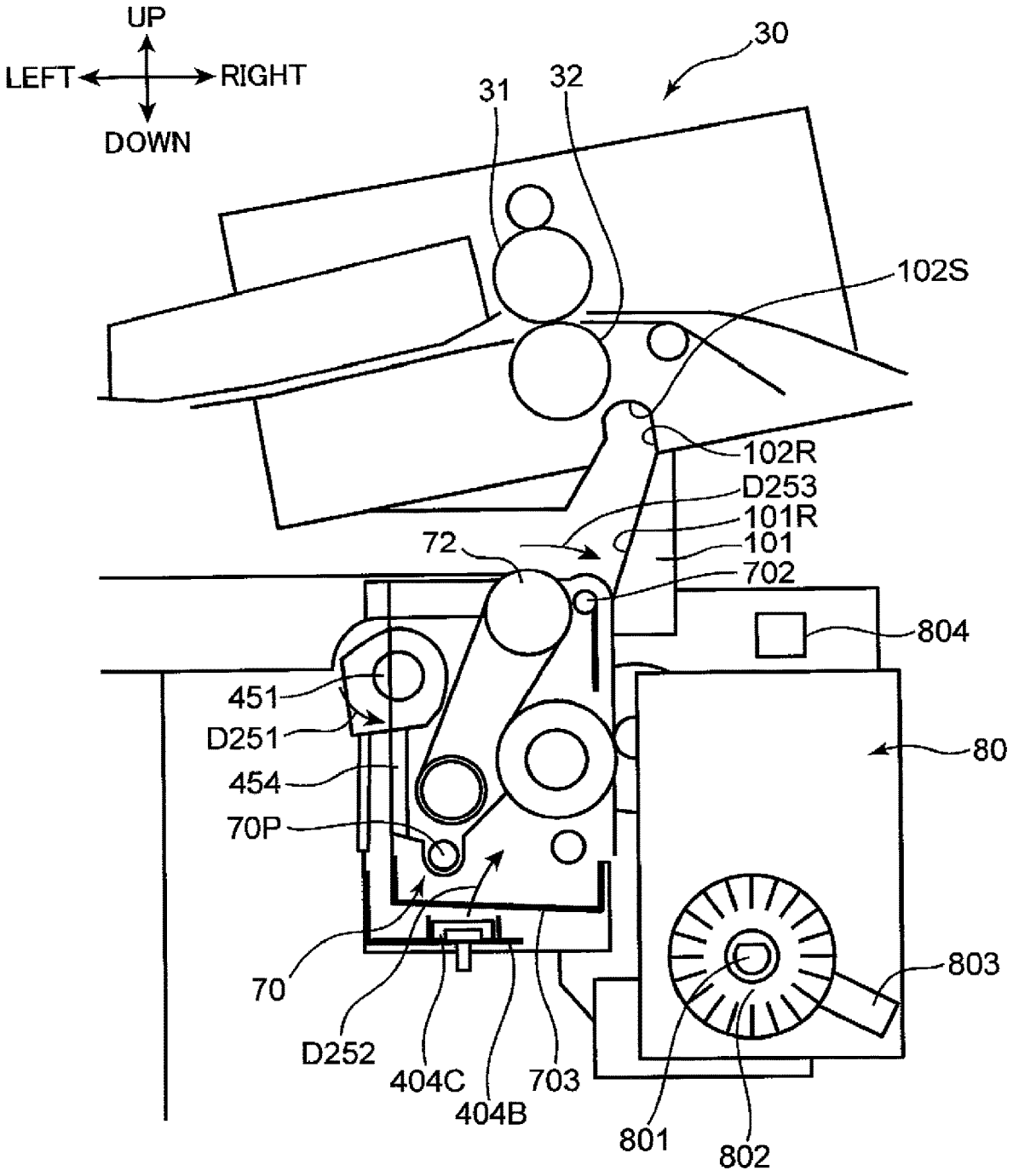
FIG. 25 is a cross-sectional view showing a state where the cleaning unit is slightly pushed up from the mounting and removing position.
Figure 27:
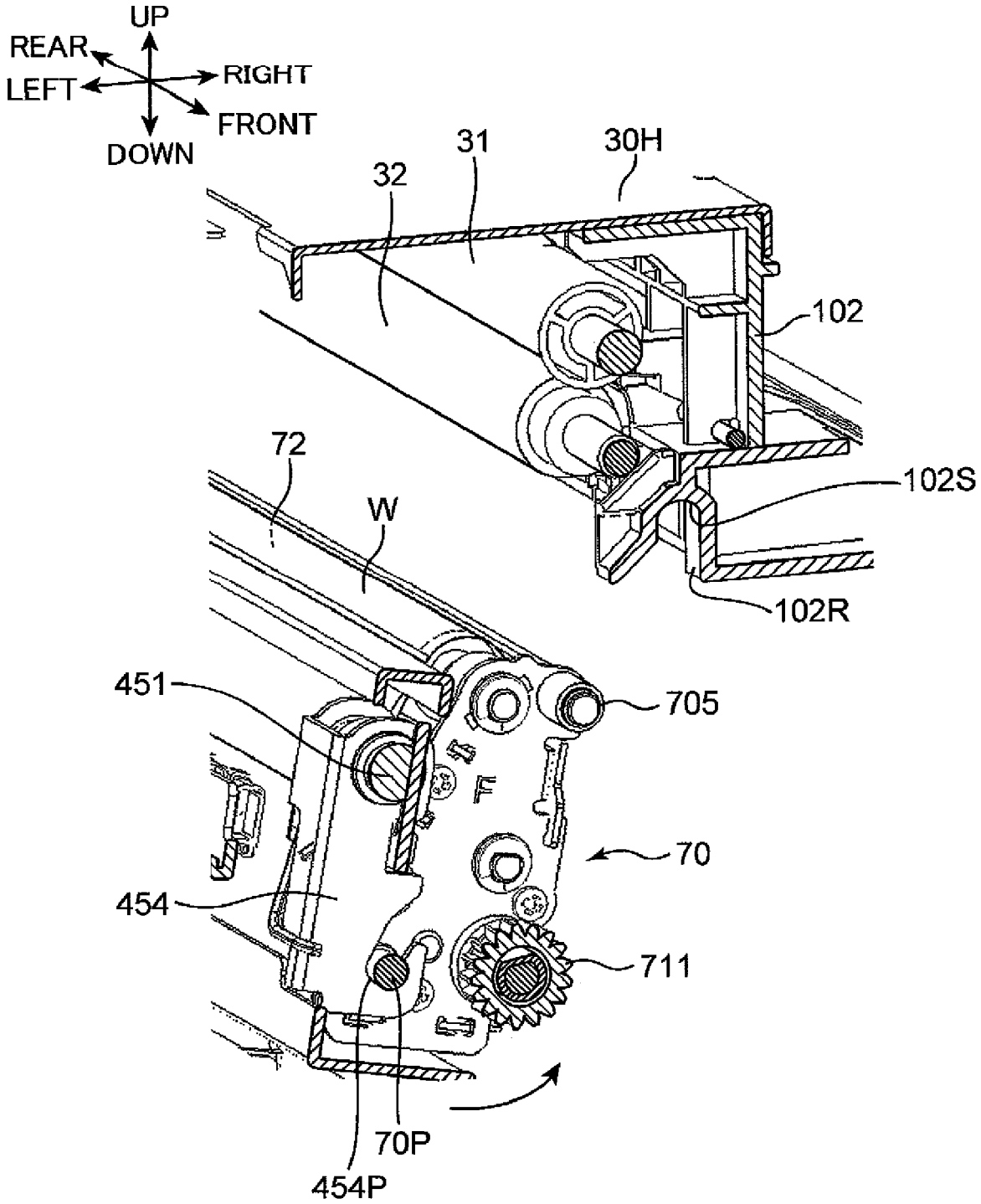
FIG. 27 is a cross-sectional perspective view showing a state where the cleaning unit is disposed at the mounting and removing position.
Figure 28:
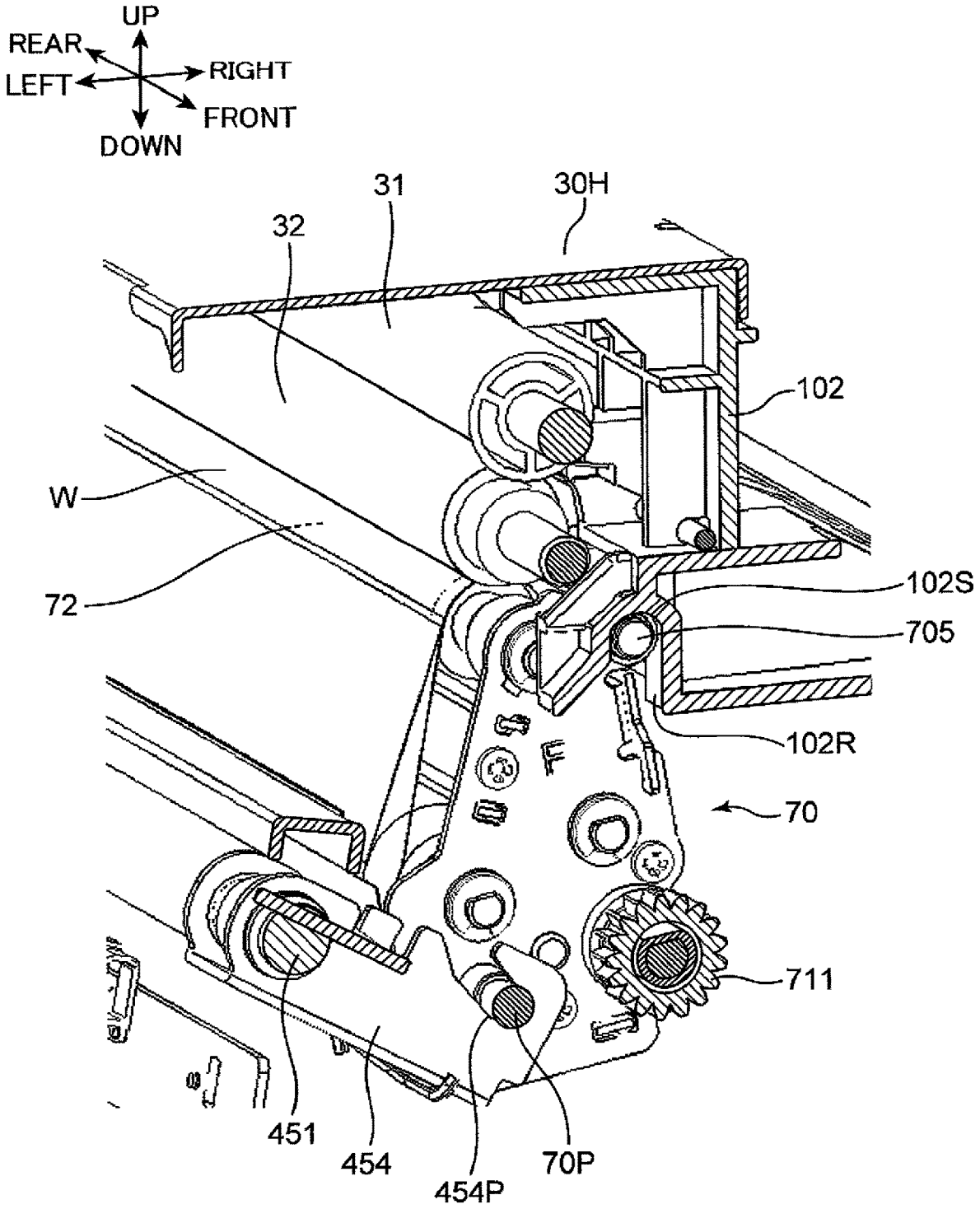
FIG. 28 is a cross-sectional perspective view showing a state where the cleaning unit is disposed at the cleaning position.
Figure 29:
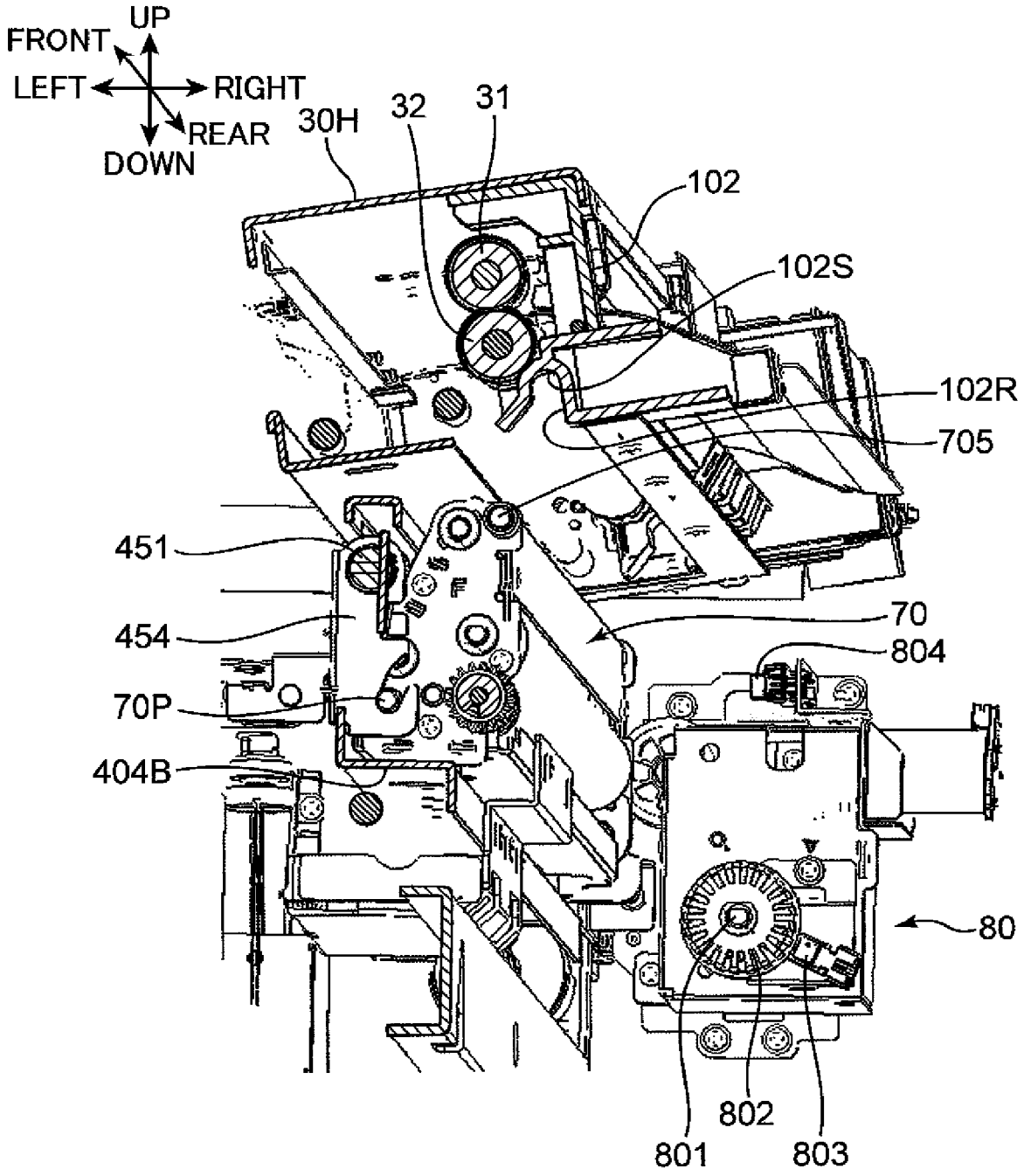
FIG. 29 is a cross-sectional perspective view showing a state where the cleaning unit is disposed at the mounting and removing position.
Figure 30:
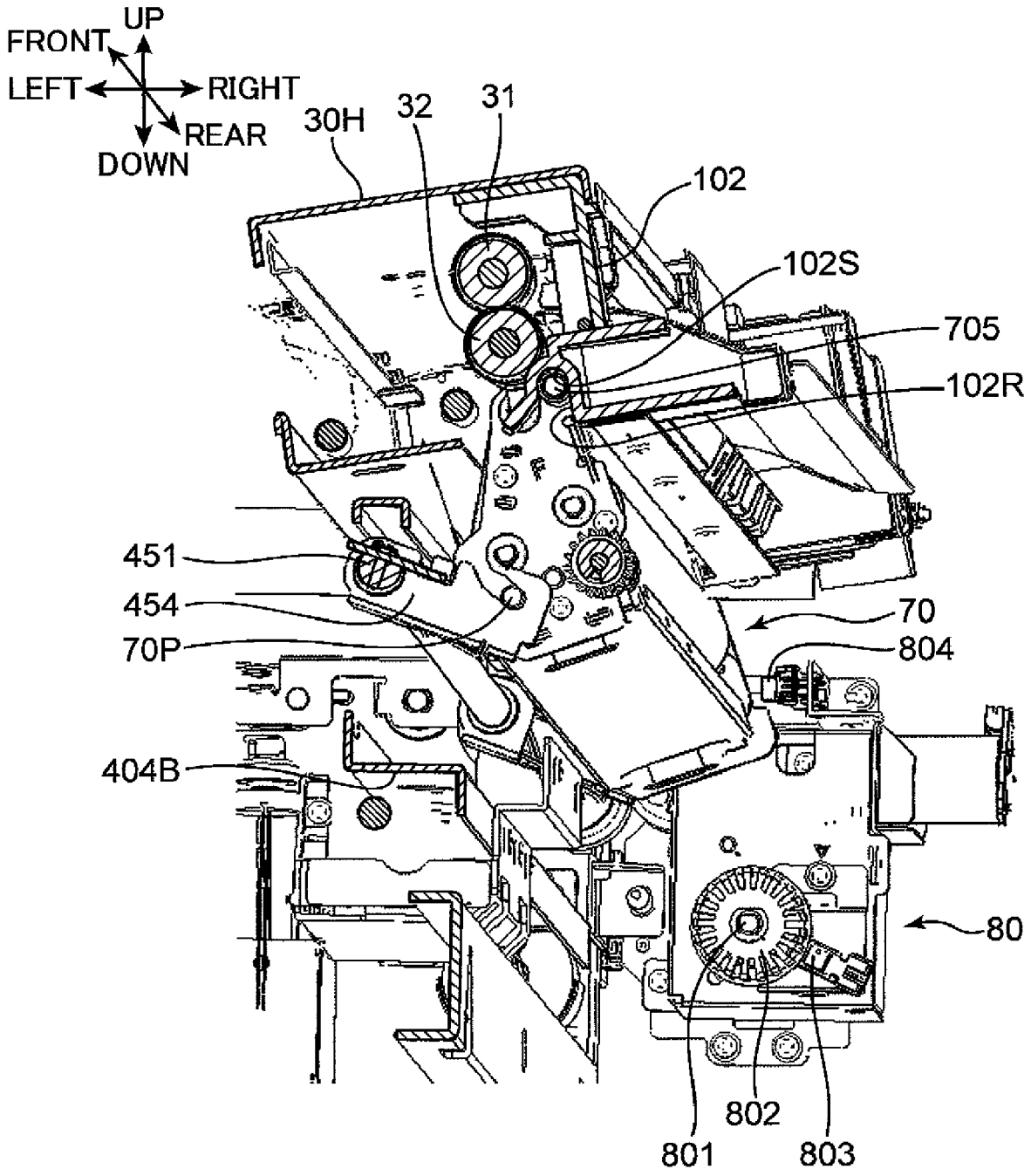
FIG. 30 is a cross-sectional perspective view of the pair of resist rollers and the cleaning unit of the image forming apparatus according to the embodiment of the present disclosure, showing a state where the cleaning unit is disposed at the cleaning position.
Figure 31:
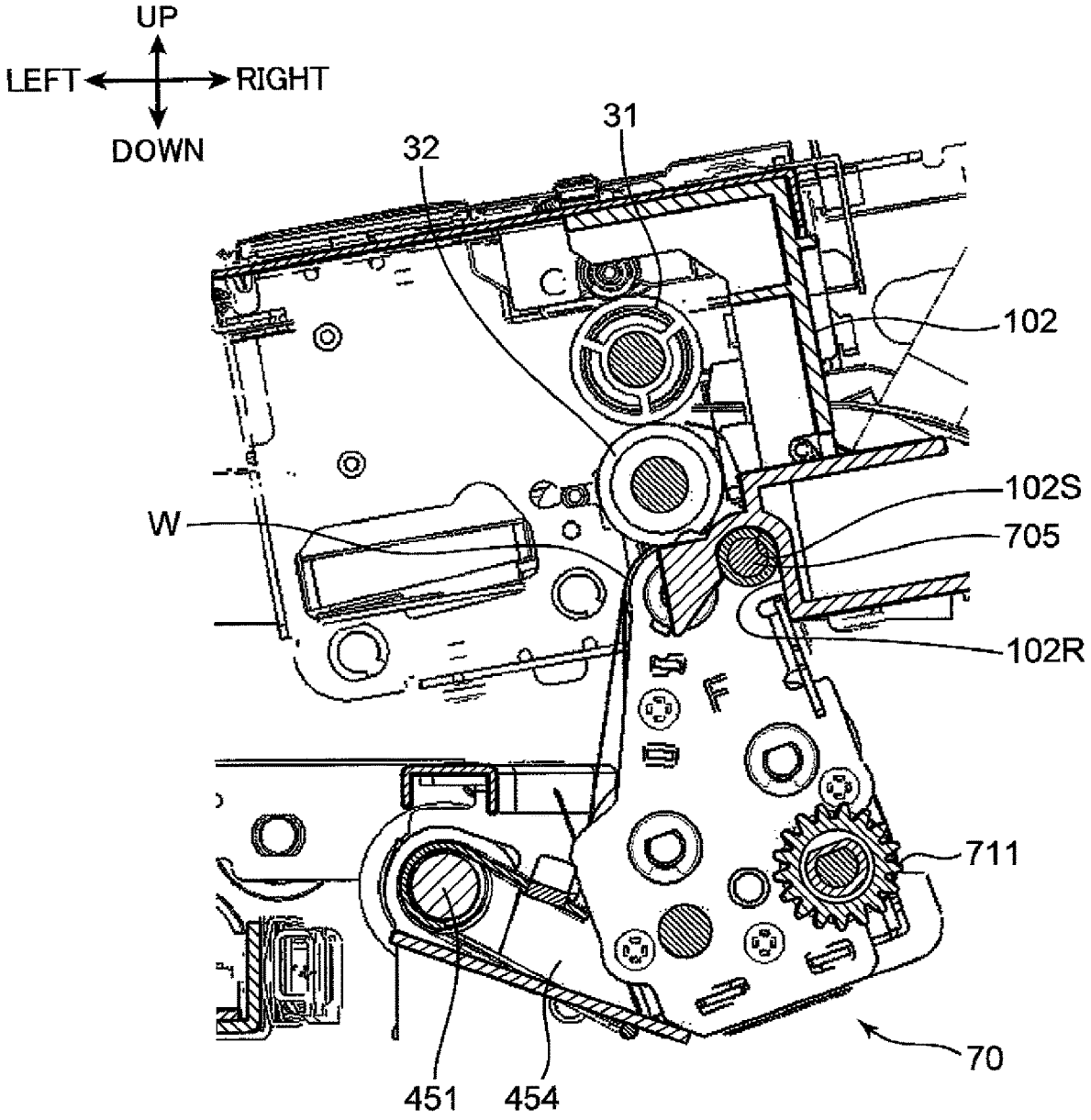
FIG. 31 is a cross-sectional view of the pair of resist rollers and the cleaning unit of the image forming apparatus according to the embodiment of the present disclosure, showing a state where the cleaning unit is disposed at the cleaning position.

FIG. 19 is a cross-sectional view showing a state where the cleaning unit 70 is about to be mounted on the conveyance unit frame 40H according to the present embodiment, and FIG. 20 is a cross-sectional view showing a state where the cleaning unit 70 is mounted on the conveyance unit frame 40H. FIGS. 21 and 22 are enlarged perspective views each showing a state where the cleaning unit 70 is mounted on the conveyance unit frame 40H. FIG. 23 is a perspective view showing a state where the cleaning unit 70 is mounted on the conveyance unit frame 40H. FIG. 24 is a cross-sectional view of the pair of resist rollers, the cleaning unit 70, and their surroundings of the image forming apparatus 1, showing a state where the cleaning unit 70 is disposed at the mounting and removing position, and FIG. 25 is a cross-sectional view showing a state where the cleaning unit 70 is slightly pushed up from the mounting and removing position. FIG. 26 is a cross-sectional view of the pair of resist rollers, the cleaning unit 70, and their surrounding of the image forming apparatus, showing a state where the cleaning unit 70 is disposed at the separation position. FIG. 27 is a cross-sectional perspective view showing a state where the cleaning unit 70 is disposed at the mounting and removing position. FIG. 28 is a cross-sectional perspective view showing a state where the cleaning unit 70 is disposed at the cleaning position. FIG. 29 is a cross-sectional perspective view showing a state where the cleaning unit 70 is disposed at the mounting and removing position. FIG. 30 is a cross-sectional perspective view showing a state where the cleaning unit 70 is disposed at the cleaning position. FIG. 31 is a cross-sectional view showing a state where the cleaning unit 70 is disposed at the cleaning position.

As shown in FIG. 24, the movement mechanism 75 further includes a guide portion 100G.

The guide portion 100G allows the pair of guide rollers 705 to be brought into contact with the guide portions 100G along with the rotation of the pair of rotary levers 454 around the first center axis, and guides the cleaning unit 70 between the cleaning position and the mounting and removing position. The guide portion 100G has a pair of front and rear first guide surfaces 101R and a pair of front and rear second guide surfaces 102R. The pair of front and rear first guide surfaces 101R is formed of left side surfaces of a pair of front and rear guide frames 101 which the body frame 100 includes. The first guide surface 101R is inclined such that the first guide surface 101R guides the cleaning unit 70 (guide roller 705) rightward as the first guide surface 101R extends upward. In the same manner, the pair of front and rear second guide surfaces 102R are formed of parts of the pair of front and rear resist frames 102 (FIG. 27) which the body frame 100 includes, respectively. The second guide surface 102R is slightly inclined such that the second guide surface 102R guides the cleaning unit 70 (guide roller 705) leftward as the second guide surface 102R extends upward.

The movement mechanism 75 has a pair of front and rear positioning portions 102S. The positioning portion 102S is brought into contact with the guide roller 705 of the cleaning unit at the cleaning position and thus positioning the cleaning unit 70 such that the web W of the cleaning part 70A can clean the resist lower roller 32. As shown in FIG. 24, the positioning portions 102S are connected to the second guide surfaces 102R, and each have an arc shape extending along an outer peripheral surface of each guide roller 705. In FIG. 24, out of the pairs of front and rear first guide surfaces 101R, front and rear second guide surfaces 102R, and front and rear positioning portions 102S, the rear first guide surface 101R, rear second guide surface 102R, and rear positioning portion 102S are shown.

As shown in FIG. 12, when the conveyance unit frame 40H is pulled out frontward from the body frame 100 of the apparatus body 10, an operator can mount the cleaning unit 70 on the cleaning unit mounting portion 40B of the conveyance unit frame 40H. At this stage of operation, as shown in FIG. 19, the pair of rotary levers 454 are disposed so as to extend downward from the rotary shaft 451, and each pin receiving portion 454P has a shape created by slantly cutting out a right side portion (one end side in a width direction) of the rotary lever 454 toward the left side (the other end side opposite to the one end side in the width direction) in a downward direction. Because of this configuration, the operator can insert and fit the pair of front and rear unit fulcrum pins 70P of the cleaning unit 70 into the pin receiving portions 454P from above (FIG. 20) while holding the side wall 703A and the bottom wall 703B (FIG. 6) of the cleaning unit 70. At this stage of the operation, the above unit input gear 711 is disposed behind the unit fulcrum pin 70P on a front side of the cleaning unit 70 (FIG. 21). The unit fulcrum pin 70P on a rear side of the cleaning unit 70 is fitted into the pin receiving portion 454P, as shown in FIG. 22.

When the pair of unit fulcrum pins 70P of the cleaning unit 70 are fitted into the pin receiving portions 454P of the pair of rotary levers 454 by the operator, the bottom wall 703B of the cleaning housing 70H is disposed so as to face the pair of magnets 404C as the pair of ribs 703T are brought into contact with the upper surface portion of the second right frame 404B. As a result, in addition to the pair of rotary levers 454, the cleaning unit 70 is held by the second right frame 404B by a magnetic field generated by the pair of magnets 404C. Accordingly, even when the operator leaves his hand from the cleaning unit 70, it is possible to prevent the cleaning unit 70 from being removed from the conveyance unit frame 40H.

As described above, when the cleaning unit 70 is mounted on the cleaning unit mounting portion 40B of the conveyance unit frame 40H (at the mounting and removing position), the operator inserts the conveyance unit frame 40H into the body frame 100 (FIG. 23). As a result, the cleaning unit 70 is inserted into the body frame 100, and the rotation input gear 40G of the conveyance unit frame 40H engages with the unit drive output gear 805 of the unit driving unit 80 in the body frame 100. At this stage of the operation, the pair of front and rear guide rollers 705 of the cleaning unit 70 are disposed so as to face the first guide surfaces 101R of the pair of front and rear guide portions 100G across a predetermined interval in the left-right direction.

As shown in FIG. 24, when the cleaning unit 70 disposed at the mounting and removing position is viewed in a direction parallel to the axial direction of the resist lower roller 32, a center (P2) of the unit fulcrum pin 70P supported by the pin receiving portion 454P is disposed below and right (on the one end side in the width direction) with respect to a center axis (P1) of the rotary shaft 451. A center of gravity (J) of the cleaning unit 70 is disposed on a right side of the unit fulcrum pin 70P. In the present embodiment, the pressing roller 72 includes the heavy pressing roller shaft 72S made of a metal material. Accordingly, the center of gravity (J) of the cleaning unit 70 is offset to a right side portion of the cleaning unit 70 so as to be positioned more on a right side than a center (P4) of the pressing roller 72. Further, a center (P3) of the magnet 404C in the left-right direction (width direction) is disposed on a right side (distal end side in a moving direction of the cleaning unit 70 in the left-right direction) of the center (P2) of the unit fulcrum pin 70P.

In a state shown in FIG. 24, the controller 90 controls the unit driving unit 80, so that the rotation drive unit 75K causes the pair of rotary levers 454 to rotate around the rotary shaft 451 (arrow D251 in FIG. 25). At this stage of the operation, a left end portion of the bottom wall 703B moves upward along with the movement of the unit fulcrum pin 70P (arrow D252 in FIG. 25). As a result, a distance between the left end portion of the bottom wall 703B and the magnet 404C is increased and hence, an effect of a magnetic restraining force generated by the magnet 404C becomes small whereby the bottom wall 703B of the cleaning unit 70 can be easily removed from the magnet 404C. Then, when the cleaning unit 70 tilts rightward around the unit fulcrum pins 70P due to its own weight (arrow D253 in FIG. 25), the pair of guide rollers 705 come in contact with the first guide surfaces 101R of the pair of guide portions 100G, respectively. In FIG. 25, because the guide rollers 705 are hid behind the rear wall 702, a part where the guide rollers 705 come in contact with the first guide surfaces 101R is not visible. Actually, however, the guide rollers 705 are in contact with the first guide surfaces 101R in the state shown in FIG. 25.

Thereafter, when the controller 90 causes the pair of rotary levers 454 to rotate further, the cleaning unit 70 moves upward and rightward while the pair of guide rollers 705 are guided by the first guide surfaces 101R. At this stage of operation, a rotation trajectory of the rotary lever 454 and a movement trajectory of the cleaning unit 70 guided by the first guide surface 101R are different from each other. In the present embodiment, the pair of unit fulcrum pins 70P of the cleaning unit 70 is supported by the pin receiving portion 454P of the rotary lever 454 so as to be rotatable relative to the pin receiving portion 454P. Because of this configuration, as shown in FIGS. 25 and 26, the orientation of the cleaning unit 70 can be changed along with its upward movement. The cleaning unit 70 is thus able to rise smoothly corresponding to the rotation of the rotary levers 454.

In a state shown in FIG. 26, the pair of guide rollers 705 are transferred from the first guide surfaces 101R to the second guide surfaces 102R. Then, when the controller 90 causes the rotary levers 454 to rotate further, the pair of guide rollers 705 are brought into contact with the pair of positioning portions 102S and are fitted therein (FIG. 31). At this stage of the operation, as shown in FIG. 2, the pressing roller 72 of the cleaning part 70A of the cleaning unit 70 is brought into contact with the resist lower roller 32 from below along the straight line L which connects the center of the resist upper roller 31 and the center of the resist lower roller 32 to each other. At this stage of operation, the rotary levers 454 slantly extend downward from the rotary shaft 451 so as to intersect the vertical direction at an acute angle (see FIG. 28). This prevents the unit fulcrum pins 70P from coming off from the pin receiving portions 454P.

In this manner, when the cleaning unit 70 reaches the cleaning position shown in FIGS. 2, 28, 30, and 31, the pressing roller 72 presses the web W to the resist lower roller 32 and hence, ink pigment, paper dust, and the like adhering to the surface of the resist lower roller 32 can be removed to clean up the surface. In the orientation of the cleaning unit 70 disposed at the cleaning position shown in FIG. 2, the center of gravity (the pressing roller 72) of the cleaning unit 70 is disposed just above the unit fulcrum pin 70P and hence, the orientation of the cleaning unit 70 at the cleaning position can be maintained in a stable manner. In addition, the controller 90 keeps supplying an exciting current to the motor of the unit driving unit 80. This prevents the rotary levers 454 from rotating in reverse, thus holding the cleaning unit 70 at the cleaning position. In another embodiment, the cleaning device 7 may be provided with a lock mechanism that locks the cleaning unit 70 to the cleaning position, and with an unlock mechanism that releases the cleaning unit 70 from its locked state to allow it to move from the cleaning position to the mounting and removing position.

As described above, in the present embodiment, the cleaning device 7 includes the cleaning unit 70 and the movement mechanism 75, and cleans the surface of the resist lower roller 32. The movement mechanism 75 can move the cleaning unit 70 at least between the cleaning position and the mounting and removing position. Accordingly, when the movement mechanism 75 disposes the cleaning unit 70 at the cleaning position, the cleaning part 70A of the cleaning unit 70 can clean the resist lower roller 32. When the movement mechanism 75 disposes the cleaning unit 70 at the mounting and removing position below the cleaning position, on the other hand, the cleaning part 70A is located below the resist lower roller 32 in a separated manner at this mounting and removing position, where the cleaning unit 70 can be mounted and removed on and from the apparatus body 10. Hence the cleaning unit 70 can be removed from the apparatus body 10 without applying a large load to the resist lower roller 32. The rotation drive unit 75K causes the pair of rotary levers 454 to rotate around the rotary shaft 451. Through this simple operation, the cleaning unit 70 can be moved between the mounting and removing position and the cleaning position. In this process, the pair of unit fulcrum pins 70P rotate relative to the pair of pin receiving portions 454P. This allows the cleaning unit 70 to maintain its orientation where the pressing roller 72 (web W) of the cleaning part 70A faces upward. Thus, the cleaning unit 70 having reached the cleaning position can come in contact with the positioning portions 102S and, at the same time, the pressing roller 72 of the cleaning part 70A can quickly come in contact from below with the resist lower roller 32.

In the present embodiment, the cleaning housing 70H has the pair of guide rollers 705. In correspondence to the rotation of the pair of rotary levers 454 caused by the rotation drive unit 75K, therefore, the pair of the guide rollers 705 and the pair of guide portions 100G guide the cleaning unit 70 stably between the mounting and removing position and the cleaning position.

As shown in FIG. 2, according to the present embodiment, the resist lower roller 32 is disposed at the position that is below the resist upper roller 31 and that is shifted rightward (i.e., toward the upstream side in the conveyance direction of the sheet S) with respect to the resist upper roller 31. As a result, the sheet S can be conveyed stably to the image forming position located below the pair of resist rollers. Meanwhile, the cleaning unit mounting portion 40B formed on the conveyance unit frame 40H is located below and left (the downstream side in the sheet conveyance direction) with respect to the pair of resist rollers. When the cleaning unit 70 is moved from the mounting and removing position, at which the cleaning unit 70 is disposed on the cleaning unit mounting portion 40B, to the cleaning position right below the resist lower roller 32, bringing the pressing roller 72 into contact with the resist lower roller 32 along the straight line L connecting the center of the resist upper roller 31 to the center of the resist lower roller 32 usually requires a complicated movement mechanism. To move the cleaning unit 70 in a linear manner, in particular, it is necessary to move the cleaning unit 70 linearly first to an intermediate position located right with respect to the mounting and removing position and then to move the cleaning unit 70 upward and leftward from the intermediate position along the straight line L. This case requires a plurality of linear movement paths intersecting each other.

In the present embodiment, in contrast, the above-described movement of the cleaning unit 70 between the mounting and removing position and the cleaning position is achieved by the rotation of the pair of rotary levers 454 and the guide function of the guide portions 100G. In particular, the rotary levers 454 cause the cleaning unit 70 to move upward and rightward from the mounting and removing position to the cleaning position. The pair of guide portions 100G, on the other hand, are arranged such that when the guide portions 100G guide the guide rollers 705 of the cleaning unit 70 toward the upper side, the movement trajectory of the pressing roller 72 of the cleaning unit 70 is made different from the rotation trajectory of the rotary levers 454, more specifically, the pressing roller 72 is allowed to reach the resist lower roller 32 by traveling through a shorter path. In addition, to allow the cleaning unit 70 to come in contact with the resist lower roller 32 along the straight line L and to prevent the cleaning unit 70 from hampering the rotation of the rotary levers 454, the unit fulcrum pins 70P of the cleaning unit 70 are allowed to rotate relative to the rotary levers 454 during the rotation of the rotary levers 454. According to such a configuration, the cleaning unit 70 can be moved between the mounting and removing position and the cleaning position in a limited space below the pair of resist rollers, and the pressing roller 72 can be brought into contact with and separated from the resist lower roller 32 along the straight line L. In addition, the cleaning unit mounting portion 40B included in the conveyance unit frame 40H can be disposed not right below the pair of resist rollers but left (closer to the belt conveyance unit 40) with respect to the pair of resist rollers. The cleaning unit mounting portion 40B is thus formed in a limited space adjacent to the conveyance unit mounting portion 40A of the conveyance unit frame 40H, which allows compactification of the conveyance unit frame 40H.

In the present embodiment, the rotary levers 454 have the pin receiving portions 454P that receive the respective unit fulcrum pins 70P. In a state where the cleaning unit 70 is disposed at the mounting and removing position, the rotation drive unit 75K causes the pair of rotary levers 454 to rotate around the axis of the rotary shaft 451 so that the unit fulcrum pins 70P move rightward and upward, thus causing the cleaning unit 70 to move to the cleaning position. According to this configuration, at the mounting and removing position, the pair of unit fulcrum pins 70P of the cleaning unit 70 can be easily moved in and out of the pin receiving portions 454P of the pair of rotary levers 454 along a direction orthogonal to the axial direction. In addition, in a state where the pair of unit fulcrum pins 70P are fitted in the pair of pin receiving portions 454P due to the weight of the cleaning unit 70, the cleaning unit 70 can be moved stably to the cleaning position located above the mounting and removing position.

In the present embodiment, when, at the mounting and removing position, the rotation drive unit 75K causes the pair of rotary levers 454 to rotate around the axis of the rotary shaft 451, the cleaning unit 70 tilts due to its own weight, causing the pair of guide rollers 705 to come in contact respectively with the pair of guide portions 100G. A different drive mechanism for bringing the pair of guide rollers 705 into contact with the pair of guide portions 100G, therefore, is unnecessary. Without such a mechanism, the cleaning unit 70 can be moved stably and smoothly from the mounting and removing position to the cleaning position.

In the present embodiment, at least one magnet 404C is disposed on the second right frame 404B. The magnetic restraining force of the magnet 404C prevents the cleaning unit 70 from coming off from the cleaning unit mounting portion 40B.

The center of the magnet 404C in the left-right direction is located right (the downstream side in the moving direction of the cleaning unit 70) with respect to the center of the unit fulcrum pin 70P supported by the pin receiving portion 454P. In this arrangement, when the rotation drive unit 75K causes the pair of rotary levers 454 to rotate, the bottom wall 703B of the cleaning unit 70 tilts, which reduces the effect of the magnetic restraining force of the magnet 404C that is exerted on the bottom wall 703B. As a result, the cleaning unit 70 can be moved easily toward the cleaning position.

In the present embodiment, the cleaning unit rotating unit 45 has the pair of coil springs 455. Because of the presence of the coil springs 455, even when the unit driving unit 80 causes the rotary shaft 451 to rotate after the cleaning unit 70 comes in contact with the positioning portions 102S, application of a large load to the pair of lever support portions 453 is prevented. This reduces the necessity of highly accurately controlling an amount of driving of the rotary shaft 451 by the unit driving unit 80, the rotary shaft 451 being driven to cause the cleaning unit 70 to reach the cleaning position.

In the present embodiment, the web W of a strip shape cleans the surface of the resist lower roller 32, thus allowing the pair of resist rollers to feed out the sheet in a stable manner. When the surface of the web W is soiled, the web drive roller 73 rotates to cause the web driven roller 71 to feed out the web W Anew contact surface thus comes in contact with the surface of the resist lower roller 32 to clean the surface.

In the present embodiment, when the cleaning unit mounting portion 40B is disposed on the conveyance unit frame 40H and the cleaning unit 70 is disposed at the mounting and removing position, the cleaning unit 70 can be mounted and removed, together with the belt conveyance unit 40, on and from the apparatus body 10. Thus, the cleaning unit 70 can be mounted and removed easily on and from the apparatus body 10 in a process of mounting and removing the belt conveyance unit 40, which conveys the sheet S, on and from the apparatus body 10.

In the present embodiment, the conveyance unit frame 40H has the first right frame 404A and the second right frame 404B. This maintains the high rigidity of the right side portion of the conveyance unit frame 40H. In addition, the space below the first right frame 404A (space between the first right frame 404A and the second right frame 404B) is used to form the cleaning unit mounting portion 40B. The rotation drive unit 75K causes the pair of rotary levers 454 to rotate around the rotary shaft 451 so that the cleaning unit 70 comes out of the cleaning unit mounting portion 40B in the rightward direction (horizontal direction orthogonal to the axial direction of the resist lower roller 32) and moves to reach the cleaning position above the first right frame 404A. Despite an upper part of the cleaning unit 70 disposed at the mounting and removing position being covered with the first right frame 404A, therefore, the cleaning unit 70 can come out of the cleaning unit mounting portion 40B in the rightward direction and move to reach the cleaning position above the first right frame 404A.

In the present embodiment, the first detection sensor 803 detects an amount of rotation of the pulse plate 802 with respect to the mounting and removing position shown in FIG. 24 that is defined as a reference position. Through this process, the amount of rotation of the rotary levers 454, that is, the position of the cleaning unit 70 (cleaning position, separation position) is detected. When the second detection sensor 804 detects the cleaning housing 70H, it is detected that the cleaning unit 70 has reached the cleaning position. When the pair of guide rollers 705 of the cleaning unit 70 come in contact with the pair of positioning portions 102S, the rotation of the rotary levers 454 is regulated by the unit fulcrum pins 70P. After the cleaning unit 70 reaches the cleaning position, however, the controller 90 still controls the unit driving unit 80 to rotate the rotary shaft 451 slightly. At this stage of operation, the coil springs 455 interposed respectively between the rotary levers 454 and the lever support portions 453 are compressed to deform between the rotary levers 454 and the lever support portions 453. This prevents (restrains) the unit driving unit 80 from applying a torque of the lever support portions 453 to the rotary levers 454 in a state where the rotary levers 454 stops rotating around the rotary shaft 451. In this manner, after the first detection sensor 803 and the second detection sensor 804 detect the cleaning unit 70 having reached the cleaning position, the rotary shaft 451 is allowed to rotate slightly. This eliminates a difference (error) in fitting position between the front and rear rotary levers 454, thus allowing the cleaning unit 70 to be certainly disposed at the cleaning position. As a result, a pressing force of the pressing roller 72 to the resist lower roller 32 can be maintained steadily.

Figure 32A:
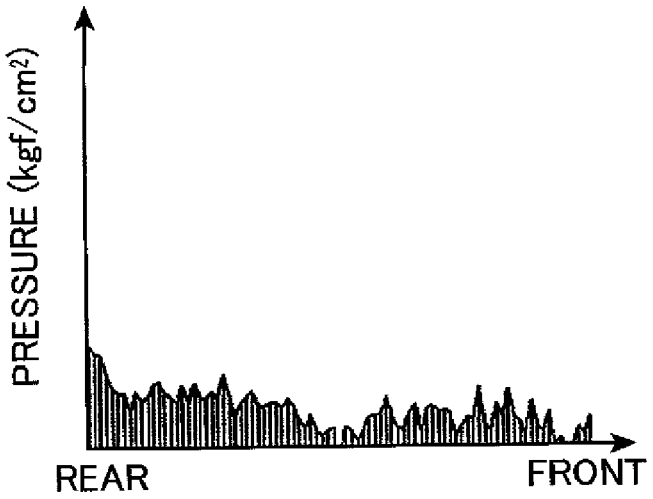
FIGS. 32A, 32B, and 32C are graphs showing nip load distributions of the pair of resist rollers.
Figure 32B:
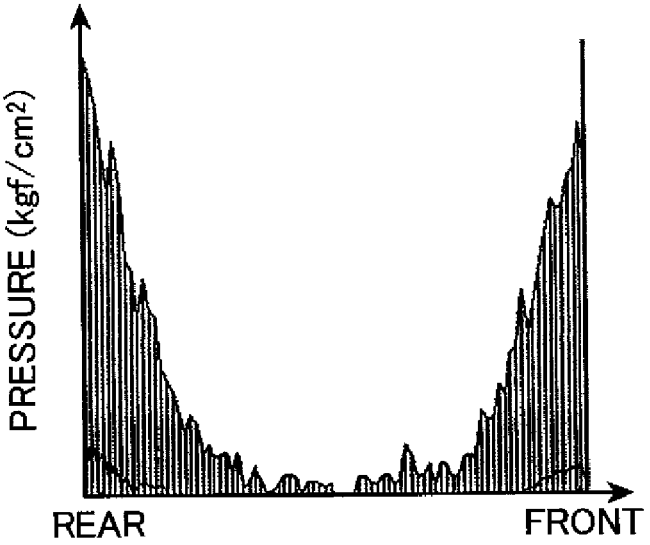
Figure 32C:
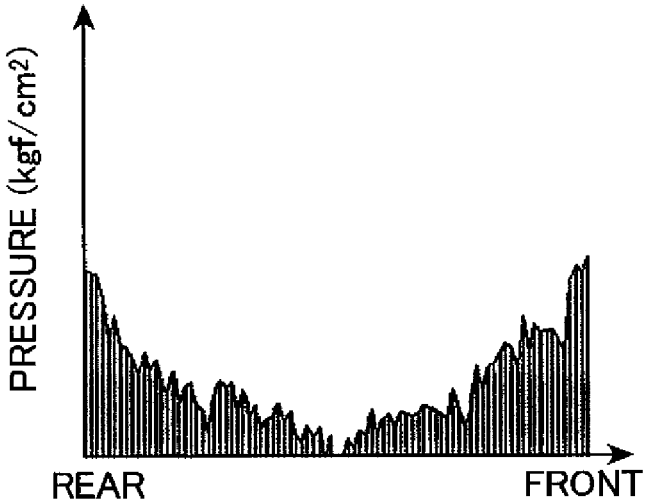
Figure 33:
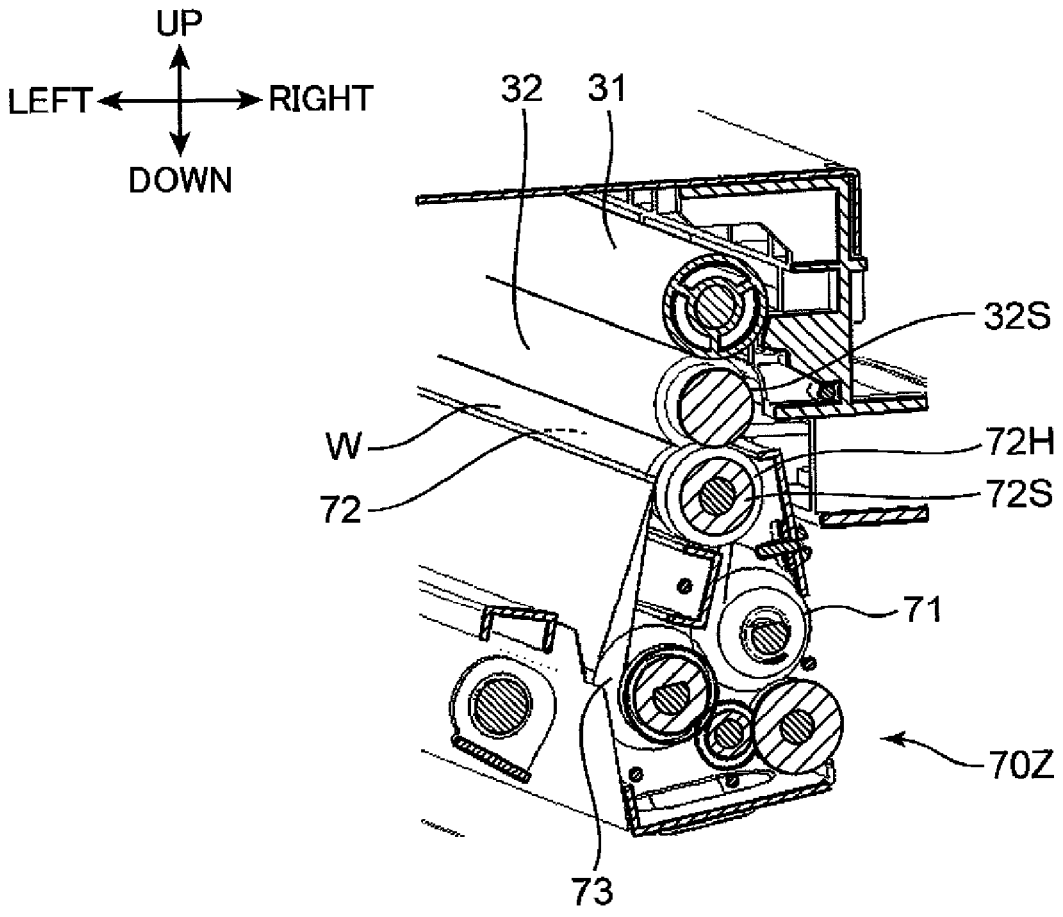
FIG. 33 is a cross-sectional perspective view of a different pair of resist rollers and a different cleaning unit that are compared with the pair of resist rollers and the cleaning unit according to the embodiment of the present disclosure.

FIGS. 32A, 32B, and 32C are graphs showing nip load distributions of the pair of resist rollers. FIG. 33 is a cross-sectional perspective view of a different pair of resist rollers and a different cleaning unit 70Z that are compared with the pair of resist rollers and the cleaning unit according to the present embodiment. FIG. 32A indicates a distribution of a nip load (pressure) in the axial direction, the nip load being applied between the resist upper roller 31 and the resist lower roller 32 in a state where the pressing roller 72 is not in contact with the resist lower roller 32. FIG. 32B indicates a distribution of the nip load in a configuration shown in FIG. 33. In the cleaning unit 70Z of FIG. 33, contact rollers 72H are fixed respectively to both end portions in the axial direction of the pressing roller shaft 72S of the pressing roller 72. The contact rollers 72H come in contact with the shaft 32S of the resist lower roller 32 to regulate an inter-shaft distance between the resist lower roller 32 and the pressing roller 72, thus regulating the pressing force of the pressing roller 72 to the resist lower roller 32. In such a case where the pressing roller 72 is positioned against the resist lower roller 32 by bringing respective parts of both rollers into contact with each other, both end portions of a nip load distribution curve representing the nip load between the resist upper roller 31 and the resist lower roller 32 tend to increase sharply, as shown in FIG. 32B. This phenomenon occurs because both end portions of the resist lower roller 32 are pressed hard against both end portions of the resist upper roller 31 by the pressing force of the pressing roller 72 to the resist lower roller 32. In this case, a nip load at both end portions of the pair of resist rollers is excessively large in comparison with a nip load at a central part of the same in the axial direction. As a result, a conveyance speed of the sheet S varies in the axial direction, in which case the sheet S tends to wrinkle.

According to the present embodiment, in contrast, the positioning portions 102S set at a position different from the position of the resist lower roller 32 receive the unit fulcrum pins 70P of the cleaning unit 70, thus regulating the position of the pressing roller 72 relative to the resist lower roller 32, as shown in FIG. 31. As a result, as indicated in FIG. 32C, an increase in the nip load of the pair of resist rollers is suppressed. Compared with the case of the cleaning unit 70Z, therefore, more stable conveyance of the sheet S by the pair of resist rollers is achieved.

In the present embodiment, when the image forming apparatus 1 performs both-side printing, the cleaning unit 70 executes an operation of cleaning the resist lower roller 32. As described above, the sheet S carrying an image formed on its front surface by both-side printing travels through the sheet reversing unit 15 and the third conveyance path 13, and is conveyed into the resist roller unit 30 again in a state where the front surface and the back surface of the sheet S are reversed. At this stage of the operation, if the ink of the image formed on the front surface adheres to the surface of the PFA tube of the resist lower roller 32, the ink adhering to the resist lower roller 32 is transferred to a distal end portion of the next sheet S, thus staining it with the ink. When the ink adhering to the resist lower roller 32 is transferred to the resist upper roller 31, on the other hand, the transferred ink then adheres to the front surface of the next sheet S, thus making a printed image defective. To deal with these problems, according to the present embodiment, the ink adhering to the resist lower roller 32 is wiped away by the web W of the cleaning unit 70 when the back surface of the sheet S passes over the resist lower roller 32 during both-side printing. To allow this operation, the controller 90 disposes the cleaning unit 70 at the cleaning position when both-side printing is executed, and disposes the cleaning unit 70 at the separation position when single-side printing is executed. As a result, the web roll WR having a limited length can perform cleaning of the resist lower roller 32 for a long time, and the web roll WR can be made compact and hence, a size of the cleaning device 7 can be made small.

When an image is formed under a condition in which the surface of the resist lower roller 32 is hardly stained, such as a single-side printing condition, the cleaning unit 70 is disposed at the separation position. This reduces a load that is applied to the resist lower roller 32 as a result of the cleaning part 70A coming in contact with the resist lower roller 32 and suppresses unnecessary feeding of the web W as well.

When finding from a detection result given by the third detection sensor 813 of the web feed-out mechanism 81 that the entire web W making up the web roll WR has been fed out from the web driven roller 71, the controller 90 causes the display unit (not shown) of the image forming apparatus 1 to display a message recommending replacement of the cleaning unit 70. When the operator enters an instruction to execute replacement of the cleaning unit 70, on an operation unit (not shown) of the image forming apparatus 1, the controller 90 controls the movement mechanism 75 to move the cleaning unit 70 to the mounting and removing position. Then, the operator pulls the conveyance unit frame 40H forward out of the body frame 100 of the apparatus body 10, and removes the cleaning unit 70 from the cleaning unit mounting portion 40B of the conveyance unit frame 40H, and then mounts a new cleaning unit 70 on the cleaning unit mounting portion 40B of the conveyance unit frame 40H. As described above, in the present embodiment, a state of the web roll WR supported on the web driven roller 71 can be visually recognized from the outside of the cleaning unit 70 through the opening portion formed between the side wall 703A and the bottom wall 703B, as shown in FIG. 5. When the operator pulls the conveyance unit frame 40H out of the body frame 100 of the apparatus body 10, therefore, the operator is able to visually recognize an amount of the remaining web roll WR of the cleaning unit 70 housed in the conveyance unit frame 40H, from the right side of the conveyance unit frame 40H having been pulled out. In other words, according to the present embodiment, the cleaning unit mounting portion 40B is disposed on a right side part of the conveyance unit frame 40H such that a right side part of the cleaning unit 70, where the web roll WR is exposed from the cleaning housing 70H to the outside, can be visually recognized.

In the present embodiment, when the cleaning unit 70 is removed from the apparatus body 10 integrally with the conveyance unit frame 40H, a part of the drive transmission system between the rotation drive unit 75K and the pair of rotary levers 454 (the engagement between an apparatus body 10G and the unit drive output gear 805) is disconnected. As a result, the pair of rotary levers 454 becomes rotatable around the rotary shaft 451. Accordingly, when the operator removes the old cleaning unit 70 from the cleaning unit mounting portion 40B, the pair of rotary levers 454 can rotate so as to send out the cleaning unit 70 to the outside of the cleaning unit mounting portion 40B. In other words, the pair of rotary levers 454 rotates around the rotary shaft 451 so as to assist the removal of the pair of unit fulcrum pins 70P of the cleaning unit 70 from the pair of pin receiving portions 454P. As a result, the operator can easily remove the pair of unit fulcrum pins 70P of the cleaning unit 70 from the pair of pin receiving portions 454P. As a result, the cleaning unit 70 can be removed easily from the conveyance unit frame 40H of the belt conveyance unit 40.

The cleaning device 7 and the image forming apparatus 1 including the cleaning device 7 according to the embodiment of the present disclosure have been described above.

According to the configurations described above, the image forming apparatus 1 can form an image steadily while cleaning the surface of the resist lower roller 32 in a stable manner.

The present disclosure is not limited to the above embodiment, and the following modified embodiments can be adopted.

(1) The above embodiment has been described as a mode in which the cleaning part 70A of the cleaning unit 70 has the web W. The cleaning part 70A that cleans the resist lower roller 32, however, is not limited to the cleaning part 70A having the web W. The cleaning part 70A may be provided as one that has a cleaning member different from the web W, such as a sponge roller and a brush roller that comes in contact with the resist lower roller 32.

(2) In the above-described embodiment, the description has been made using the resist lower roller 32 as the conveyance roller to be cleaned by the cleaning unit 70. However, the conveyance roller may be another roller which conveys the sheet S.

(3) Further, in the above-described embodiment, the description has been made with respect to the mode where the image forming unit 50 is formed of an ink-jet-type image forming unit. However, the image forming unit 50 may be formed of an image forming unit which adopts another image forming method such as a publicly known electrophotographic method.

Although the present disclosure has been fully described by way of example with reference to the accompanying drawings, it is to be understood that various changes and modifications will be apparent to those skilled in the art. Therefore, unless otherwise such changes and modifications depart from the scope of the present disclosure hereinafter defined, they should be construed as being included therein.

The invention claimed is:

1. A cleaning device that is attached to an image forming apparatus including an apparatus body, a conveyance roller supported rotatably on the apparatus body, the conveyance roller conveying a sheet, and a processing unit configured to be mounted and removed on and from the apparatus body, and that is configured to clean a surface of the conveyance roller, the cleaning device comprising:

a cleaning unit including a cleaning part being brought into contact with the surface of the conveyance roller to clean the surface of the conveyance roller;

a movement mechanism that moves the cleaning unit between a cleaning position at which the cleaning part comes in contact with the conveyance roller, and a mounting and removing position at which the cleaning part is disposed separate from the conveyance roller and the cleaning unit is allowed to be mounted and removed on and from the apparatus body; and a unit mounting portion disposed on the processing unit, the unit mounting portion allowing the cleaning unit to be mounted on the unit mounting portion, wherein the cleaning unit is configured such that the cleaning unit, in a state of being mounted on the unit mounting portion, is mounted on the apparatus body and removed from the apparatus body together with the processing unit, and the cleaning unit is configured so that, in a state of the cleaning unit being removed together with the processing unit from the apparatus body, the cleaning unit is mountable on and removable from the unit mounting portion.

2. The cleaning device according to claim 1, wherein the cleaning unit is not mountable and removable on and from the apparatus body together with the processing unit when the cleaning unit is in the cleaning position, and the cleaning unit is mountable and removable on and from the apparatus body together with the processing unit when the cleaning unit is in the mounting and removing position.

3. The cleaning device according to claim 1, wherein the cleaning part is brought into contact with the surface of the conveyance roller from a first direction, the cleaning unit further includes a cleaning housing having at least one housing shaft portion along an axial direction of the conveyance roller, the movement mechanism includes:

at least one support member disposed on the unit mounting portion, the support member having at least one support portion that receives and rotatably supports the housing shaft portion, respectively, and being configured to support the cleaning housing; and a rotation drive unit that causes the support member to rotate around a center axis located parallel to the axial direction so that in a state where the housing shaft portion is pivotally supported by the support portion, the cleaning unit moves between the cleaning position and the mounting and removing position, and the rotation drive unit causes the support member to rotate while allowing the housing shaft portion to rotate relative to the support portion so that the cleaning unit maintains an orientation where the cleaning part faces in a direction opposite to the first direction.

4. The cleaning device according to claim 3, wherein the cleaning unit further includes a pair of wall portions disposed so as to face each other in the axial direction to support the cleaning part, the cleaning housing of the cleaning unit has a connection wall made of a magnetic material, the connection wall connecting the pair of wall portions to each other along the axial direction, and the unit mounting portion has at least one magnetic member disposed so as to face the connection wall of the cleaning unit disposed at the mounting and removing position, the magnetic member generating a magnetic field for holding the cleaning unit.

5. The cleaning device according to claim 1, wherein the cleaning part is brought into contact with the surface of the conveyance roller from a first direction, the cleaning unit further includes a cleaning housing having:

a pair of wall portions disposed so as to face each other in the axial direction to support the cleaning part; and a pair of housing shaft portions formed in a protruding manner to protrude from outer surfaces of the pair of wall portions, respectively, in the axial direction, the movement mechanism includes:

a pair of support members disposed on the unit mounting portion, the support members having pivotally supporting portions that receive and rotatably support the housing shaft portions, respectively, and being configured to support the cleaning housing so as to sandwich the cleaning housing from both sides in the axial direction; and a rotation drive unit that causes the pair of support members to rotate around a center axis located at a side of a second direction opposite to the first direction with respect to the pivotally supporting portions and parallel to the axial direction so that in a state where the pair of housing shaft portions are pivotally supported by the pair of pivotally supporting portions, the cleaning unit moves between the cleaning position and the mounting and removing position, and the rotation drive unit causes the pair of support members to rotate while allowing the pair of housing shaft portions to rotate relative to the pair of pivotally supporting portions so that the cleaning unit maintains an orientation where the cleaning part faces in the second direction.

6. An image forming apparatus comprising:

an apparatus body;

a conveyance roller supported rotatably on the apparatus body, the conveyance roller conveying a sheet;

a processing unit configured to be mounted and removed on and from the apparatus body; and the cleaning device according to claim 1, the cleaning device being configured to clean a surface of the conveyance roller.

7. The image forming apparatus according the claim 6, wherein the processing unit is a conveyance unit including a conveyance portion that conveys a sheet at a position difference from a position of the conveyance roller.

8. The cleaning device according to claim 1, wherein the cleaning unit further includes a cleaning housing having at least one housing shaft portion along an axial direction of the conveyance roller, the movement mechanism includes at least one support portion disposed on the unit mounting portion, the support portion receiving and rotatably supporting the housing shaft portion, and the housing shaft portion is mounted on and removed from the support portion.

9. A cleaning device that is attached to an image forming apparatus including an apparatus body, a conveyance roller supported rotatably on the apparatus body, the conveyance roller conveying a sheet, and a processing unit configured to be mounted and removed on and from the apparatus body, and that is configured to clean a surface of the conveyance roller, the cleaning device comprising:

a cleaning unit including a cleaning part being brought into contact with the surface of the conveyance roller to clean the surface of the conveyance roller;

a movement mechanism that moves the cleaning unit between a cleaning position at which the cleaning part comes in contact with the conveyance roller, and a mounting and removing position at which the cleaning part is disposed separate from the conveyance roller and the cleaning unit is allowed to be mounted and removed on and from the apparatus body; and a unit mounting portion disposed on the processing unit, the unit mounting portion allowing the cleaning unit to be mounted on the unit mounting portion, wherein the cleaning unit is configured such that the cleaning unit in a state of being mounted on the unit mounting portion is mounted and removed, together with the processing unit, on and from the apparatus body, wherein the cleaning part is brought into contact with the surface of the conveyance roller from a first direction, the cleaning unit further includes a cleaning housing having at least one housing shaft portion along an axial direction of the conveyance roller, the movement mechanism includes:

at least one support member disposed on the unit mounting portion, the support member having at least one support portion that receives and rotatably supports the housing shaft portion, respectively, and being configured to support the cleaning housing; and a rotation drive unit that causes the support member to rotate around a center axis located parallel to the axial direction so that in a state where the housing shaft portion is pivotally supported by the support portion, the cleaning unit moves between the cleaning position and the mounting and removing position, and the rotation drive unit causes the support member to rotate while allowing the housing shaft portion to rotate relative to the support portion so that the cleaning unit maintains an orientation where the cleaning part faces in a direction opposite to the first direction, and wherein the first direction is a downward direction, in a state where the cleaning unit is disposed at the mounting and removing position, the support member is disposed so as to extend downward from the center axis, and the support portion has a shape created by slantly cutting out a first side portion of the support member downwardly toward a second side portion opposite to the first side portion, in a horizontal width direction orthogonal to the axial direction.

10. A cleaning device that is attached to an image forming apparatus including an apparatus body, a conveyance roller supported rotatably on the apparatus body, the conveyance roller conveying a sheet, and a processing unit configured to be mounted and removed on and from the apparatus body, and that is configured to clean a surface of the conveyance roller, the cleaning device comprising:

a cleaning unit including a cleaning part being brought into contact with the surface of the conveyance roller to clean the surface of the conveyance roller;

a movement mechanism that moves the cleaning unit between a cleaning position at which the cleaning part comes in contact with the conveyance roller, and a mounting and removing position at which the cleaning part is disposed separate from the conveyance roller and the cleaning unit is allowed to be mounted and removed on and from the apparatus body; and a unit mounting portion disposed on the processing unit, the unit mounting portion allowing the cleaning unit to be mounted on the unit mounting portion, wherein the cleaning unit is configured such that the cleaning unit in a state of being mounted on the unit mounting portion is mounted and removed, together with the processing unit, on and from the apparatus body, wherein the cleaning part is brought into contact with the surface of the conveyance roller from a first direction, the cleaning unit further includes a cleaning housing having at least one housing shaft portion along an axial direction of the conveyance roller, the movement mechanism includes:

at least one support member disposed on the unit mounting portion, the support member having at least one support portion that receives and rotatably supports the housing shaft portion, respectively, and being configured to support the cleaning housing; and a rotation drive unit that causes the support member to rotate around a center axis located parallel to the axial direction so that in a state where the housing shaft portion is pivotally supported by the support portion, the cleaning unit moves between the cleaning position and the mounting and removing position, and the rotation drive unit causes the support member to rotate while allowing the housing shaft portion to rotate relative to the support portion so that the cleaning unit maintains an orientation where the cleaning part faces in a direction opposite to the first direction, and wherein in a state where the cleaning unit is removed, together with the processing unit, from the apparatus body, the support member is rendered rotatable around the center axis so as to assist in removing the housing shaft portion from the support portions.

* * * * *